US005720193A

United States Patent [19]

Dick

[11] Patent Number: 5,720,193

[45] Date of Patent: Feb. 24, 1998

[54] PUSH BUTTON FIREARM LOCK

[76] Inventor: Daniel J. Dick, 15202 N. 28th Dr., Phoenix, Ariz. 85023

[21] Appl. No.: 420,071

[22] Filed: Apr. 11, 1995

[51] Int. Cl.[6] ..... E05B 37/16

[52] U.S. Cl. ..... 70/298; 70/57; 70/58; 70/164; 70/62; 70/319; 211/64; 42/70.11; 42/70.7

[58] Field of Search ..... 206/317; 70/57, 70/58, 163–169, 62, 61, 158, 299, 298, 297, 316–319, 63; 42/70.7, 70.11, 94; 211/64

[56] References Cited

U.S. PATENT DOCUMENTS

| | | | |
|---|---|---|---|
| 1,085,894 | 2/1914 | Eagle | 70/298 |
| 1,608,539 | 11/1926 | Wetherell | 70/299 |
| 2,505,227 | 4/1950 | Charters | 42/70 |
| 2,512,140 | 6/1950 | Childs et al. | 42/70 |
| 2,618,957 | 11/1952 | Tonnessen | 70/378 |
| 2,706,393 | 4/1955 | Jamieson et al. | 70/63 |
| 2,742,726 | 4/1956 | Feller, Sr. | 42/70 |
| 3,022,596 | 2/1962 | Cannon | 42/1 |
| 3,031,787 | 5/1962 | Womble, Jr. | 42/70 |
| 3,066,433 | 12/1962 | Rogers et al. | 42/70 |
| 3,137,957 | 6/1964 | Ingalls | 42/1 |
| 3,164,919 | 1/1965 | Hall | 42/70 |
| 3,269,046 | 8/1966 | Schaefer | 42/70 |
| 3,368,297 | 2/1968 | Lentz | 42/1 |
| 3,422,560 | 1/1969 | Foote et al. | 42/70 |
| 3,616,559 | 11/1971 | Sobolewski | 42/1 |
| 3,624,945 | 12/1971 | Foote | 42/1 Y |
| 3,673,725 | 7/1972 | Cravener | 42/1 R |
| 4,299,045 | 11/1981 | Cervantes | 42/1 Y |
| 4,721,205 | 1/1988 | Burt et al. | 206/317 |
| 4,747,280 | 5/1988 | Shaw | 70/277 |
| 4,763,431 | 8/1988 | Allan et al. | 42/70.11 |
| 4,936,894 | 6/1990 | Larson | 70/298 |
| 4,952,228 | 8/1990 | Taylor et al. | 70/25 |
| 4,959,978 | 10/1990 | Cappell et al. | 70/25 |
| 5,022,175 | 6/1991 | Oneke et al. | 42/70.11 |
| 5,056,342 | 10/1991 | Prinz | 70/63 |
| 5,058,404 | 10/1991 | Fish et al. | 70/315 |
| 5,111,755 | 5/1992 | Rouse | 70/63 |
| 5,138,786 | 8/1992 | Fischer | 211/64 |
| 5,189,894 | 3/1993 | Buck | 70/63 |
| 5,229,532 | 7/1993 | Brooks | 42/70.11 |
| 5,283,971 | 2/1994 | Fuller et al. | 42/70.07 |
| 5,372,020 | 12/1994 | Stoltz et al. | 70/57.1 |
| 5,392,552 | 2/1995 | McCarthy et al. | 42/70.11 |
| 5,487,234 | 1/1996 | Dragon | 42/70.07 |

FOREIGN PATENT DOCUMENTS

| | | | |
|---|---|---|---|
| 1455444 | 11/1976 | United Kingdom | 70/368 |

*Primary Examiner*—Darnell M. Boucher
*Attorney, Agent, or Firm*—Halvorson & Venable, P.C.

[57] ABSTRACT

A detachable push button firearm lock is provided. The lock comprises; a housing, and a plurality of pin sets. The housing halves are interlocking and separation capable thereby locking or making available a desired firearm. Access blocking means for the ammunition, magazine, bolt, breech, hammer, slide, actions, and firing capability is also provided. The lock is user recodable by providing a plurality of identical corresponding locking and unlocking pins, when rotated end over end, cause a combination change. Tamper resistance as well as accompanying tamper resistant unlocking means is also disclosed. Optional ease of use features including open latch, closed latch, open stop, and digit grips are also depicted. Further, optional portability and or stationary mounting means are also provided as well as display only means. The arrangement of basic, simplified, tamper resistant, and or optional features illustrates a means whereby a economical, multiple firearm applicable, and user friendly firearm security device can be employed.

21 Claims, 18 Drawing Sheets

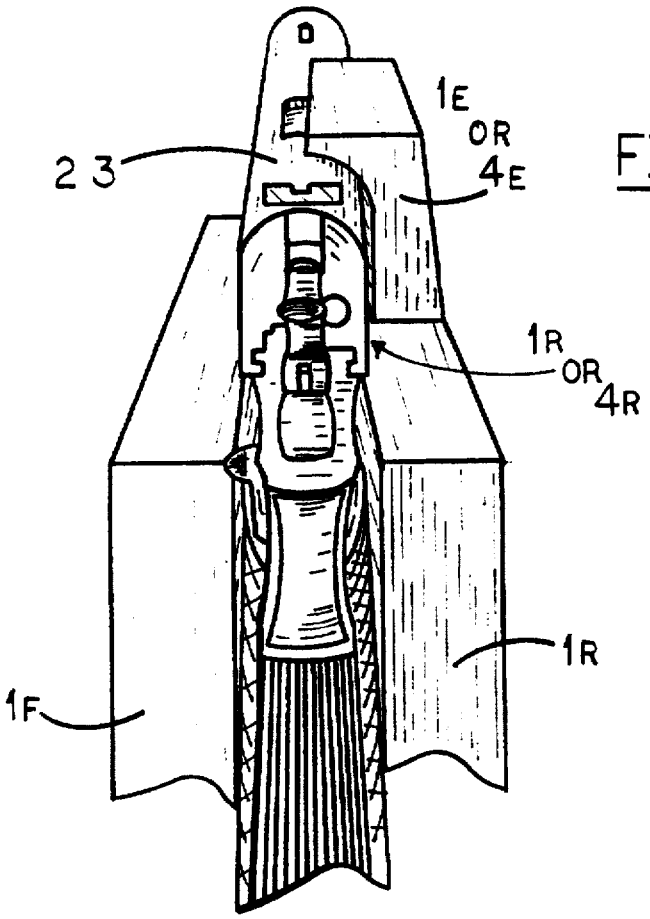
FIG. 30
FIG. 32a
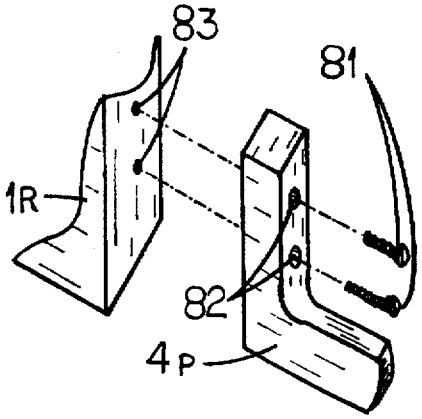
FIG. 31
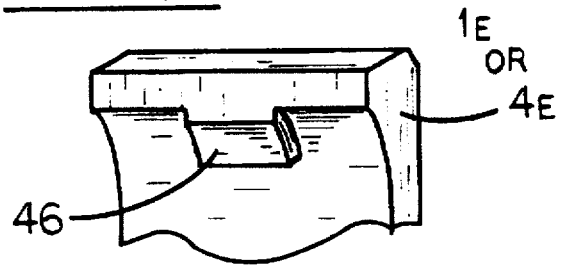
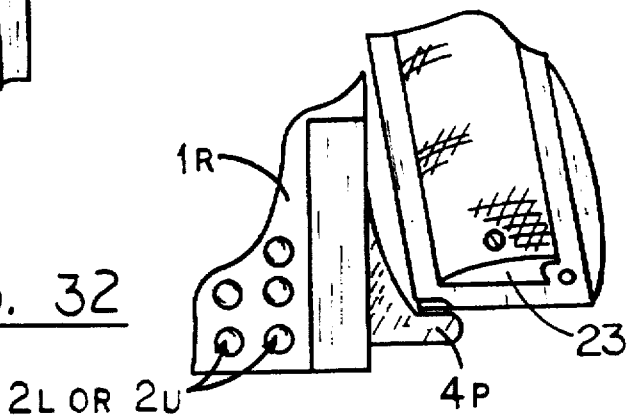
FIG. 32

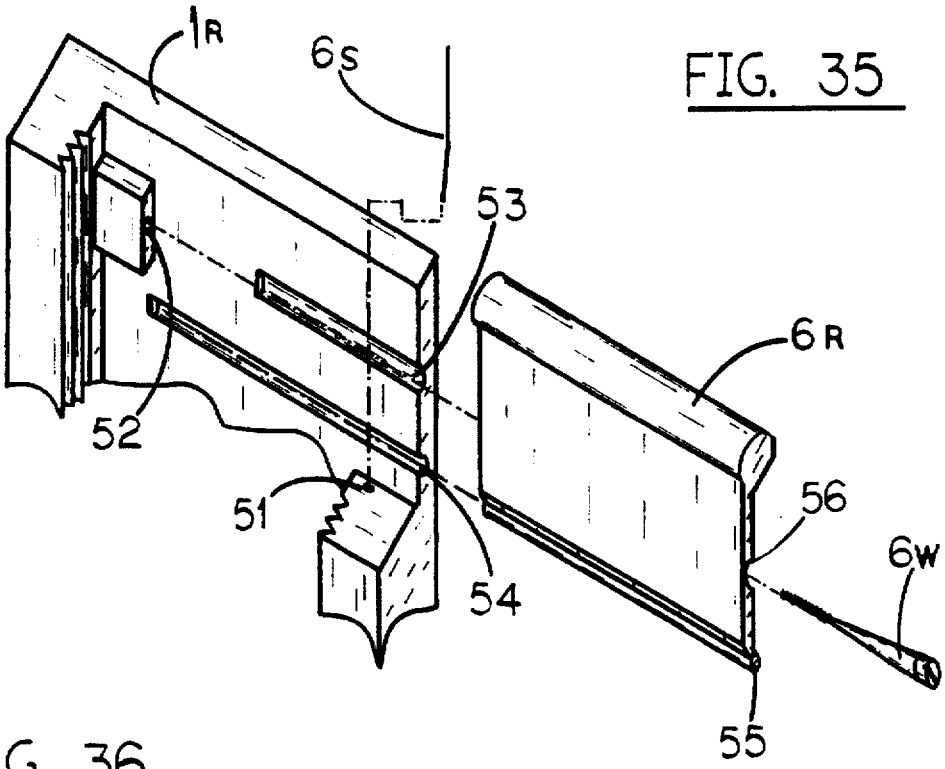
FIG. 35
FIG. 36
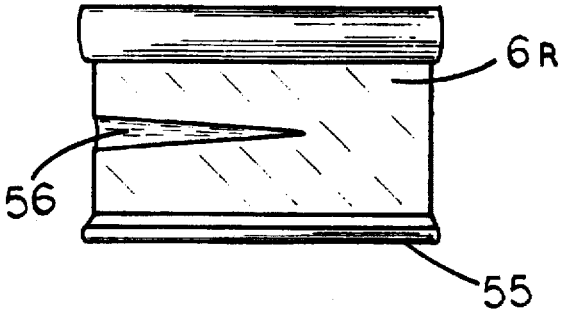
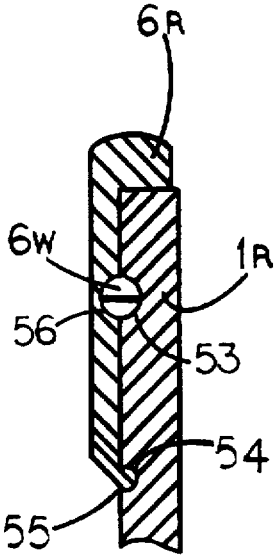
FIG. 37

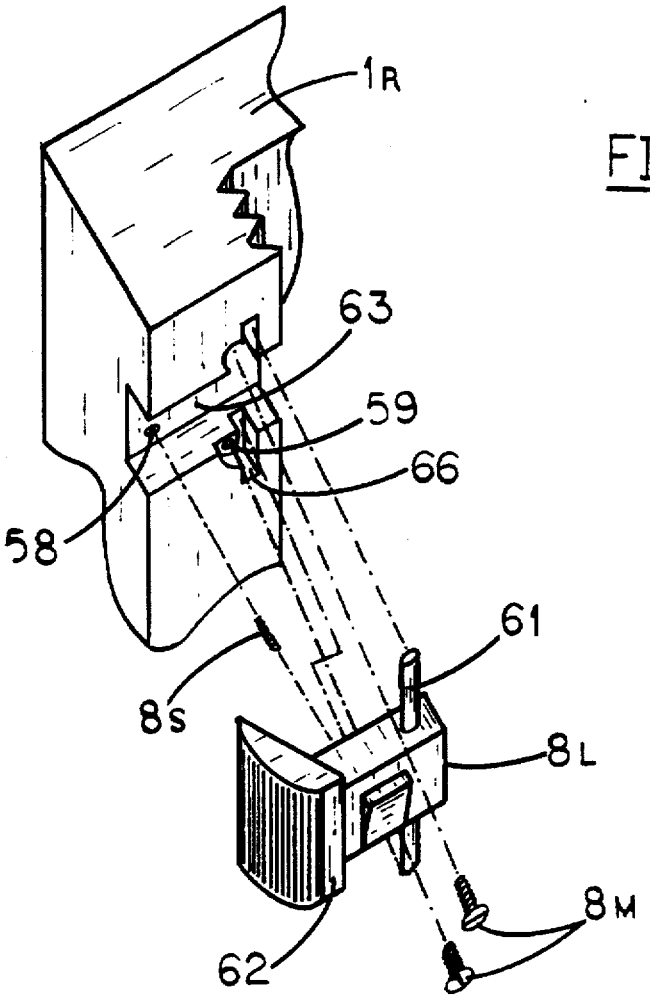
FIG. 40
FIG. 40a
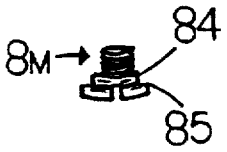
FIG. 41
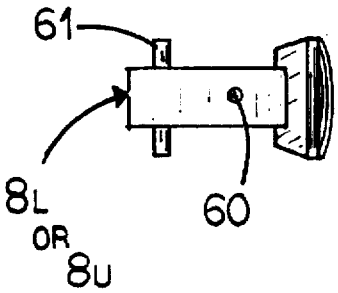
FIG. 42
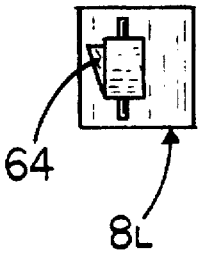
FIG. 43
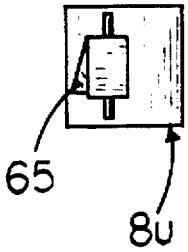

PUSH BUTTON FIREARM LOCK

BACKGROUND—FIELD OF INVENTION

This invention relates to firearm safety devices, specifically to keyless firearm locks.

BACKGROUND—DESCRIPTION OF PRIOR ART

It has become clear over the years there is a need for a safe, simple, economical, and expedient to use, firearm lock.

Many inventions have been brought forth to accomplish this, however they still have drawbacks. U.S. Pat. No. 3,624,945 to Foote (1971) discloses a trigger lock requiring a key to open. This type of firearm lock forces the safety minded user to store the key in a different location than the firearm. It also does not prevent access to ammunition housed in the firearm. U.S. Pat. No. 5,283,971 to Fuller and Fuller (1994) shows a battery powered, keyless trigger lock. This lock does not require a key, however it does not prevent access to ammunition housed within the firearm. It also requires maintenance of a battery and has electronic components that can be adversely affected by the environment. U.S. Pat. No. 4,763,431 to Allen and Allen (1988) displays a keyless firearm locking device that blocks the unauthorized use of the firearm. This lock does protect the ammunition housed within the firearm, however it is very complex and prevents the user from easily recoding the combination. It also contains the locking apparatus within the construction of the firearm and could thereby suffer damage due to shock when the firearm is discharged. U.S. Pat. No. 5,022,175 to Oncke and Van der Merwe (1991) shows a keyless firearm lock. This lock protects the ammunition housed within the firearm and prevents unauthorized firing of the weapons however it also requires battery maintenance and has electronic components vulnerable to the environment. U.S. Pat. No. 5,229,532 (1993) to Brooks discloses a lock that is also complex and is contained within the firearm. U.S. Pat. No. 4,299,045 (1981) to Cervantes displays a keyless firearm lock with backplate that is operational in the dark, however it also requires battery and light bulb maintenance. U.S. Pat. No. 3,031,787 (1962) to Womble displays a firearm safety device that also acts as a display stand, however this system requires an exterior lock and would not protect the ammunition on semi-automatic firearms. The Prior Art references described above are examples of inventions that solve some of the requirements needed, but nevertheless suffer from one or more disadvantages:

a) Design requires a key to operate. This forces the user to store the key in a different location, thereby lengthening the time needed to access the firearm.
b) Does not prevent access to the ammunition if stored in the firearm. This also forces the user to store the ammunition in a different location, thereby lengthening the time needed, to make the firearm operational.
c) Does not allow for easy recoding by the user. In the event the code for opening is discovered by an unauthorized person, it would require the user to take the lock to a service person for recoding.
d) Complex design can greatly increase the expense to manufacture and distribute an invention.
e) Requires battery maintenance. A battery is often neglected until it is needed and a firearm lock may not be a top priority until it is to late.
f) Requires light bulb replacement. It is typically when we need a light to operate, when it tends to fail.
g) Is not capable of being portable or fixed in a stationary condition using the same device. This ability is often desirable when the portability of a locked firearm is required.

h) Is not easily adaptable to a multiple of firearm types. This condition of previous inventions has required the manufacture to produce one lock for one brand or style of firearm but then required them to construct a different lock for other brands and styles.

OBJECTS AND ADVANTAGES

Accordingly, several objects and advantages to my present invention are:

a) to provide a firearm lock that is keyless;
b) to provide a keyless firearm lock that is operational in the dark;
c) to provide a keyless firearm lock that is recodable by the user;
d) to provide a keyless firearm lock that can be portable or fixed;
e) to provide a keyless firearm lock that is completely mechanical and does not require maintenance of batteries, bulbs or electronics;
f) to provide a keyless firearm lock that detaches from the firearm;
g) to provide a keyless firearm lock that can be used to display the firearm housed therein;
h) to provide a non-locking device suitable for display;
i) to provide a keyless firearm lock that adapts easily to a large variety of firearms;
j) to provide a simple configuration with as few unlike components possible;
k) to provide a tamper resistent keyless firearm lock; and
l) to provide an override for the tamper resistent keyless firearm lock.

Further objects and advantages are to provide a keyless firearm lock that is easy to operate, economical to mass produce, adapts to a large variety of firearms, is completely mechanical, and protects the firearm and ammunition in the event they are stored together.

DRAWING FIGURES

FIG. 30 is a fragmented rear view of the upper lock assemblage with a typical semi-automatic firearm installed therein.

FIG. 31 is a fragmented inside view of either the upper rear housing or upper rear adapter with an ejection port protrusion.

FIG. 32 is a fragmented inside view of the lower right corner of the rear housing with magazine access blocker.

FIG. 32*a* is a fragmented isometric view of the separable magazine access blocker.

Figure 33:
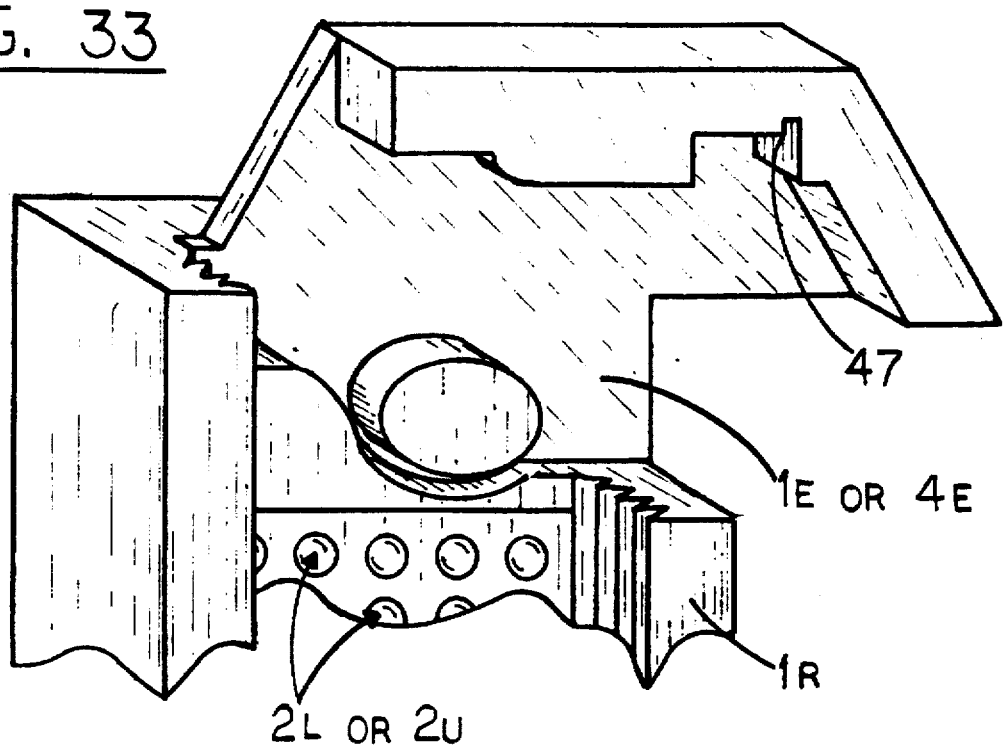

FIG. 33 is a fragmented upper inside view of either the rear housing or rear adapter, used with a semi-automatic firearm without an ejection port.

Figure 34:
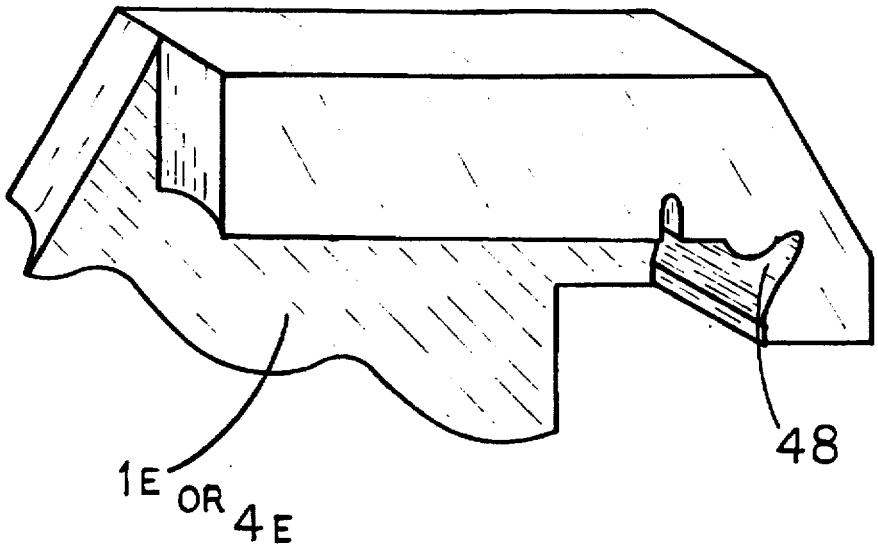

FIG. 34 is a fragmented upper inside view of either the rear housing or the rear adapter for blocking access to the hammer of a firearm.

FIG. 35 is a fragmented upper inside exploded view of the rear housing with an alternative wedging means for multiple firearm use.

FIG. 36 is an inside view of the wedging block.

Figure 3:
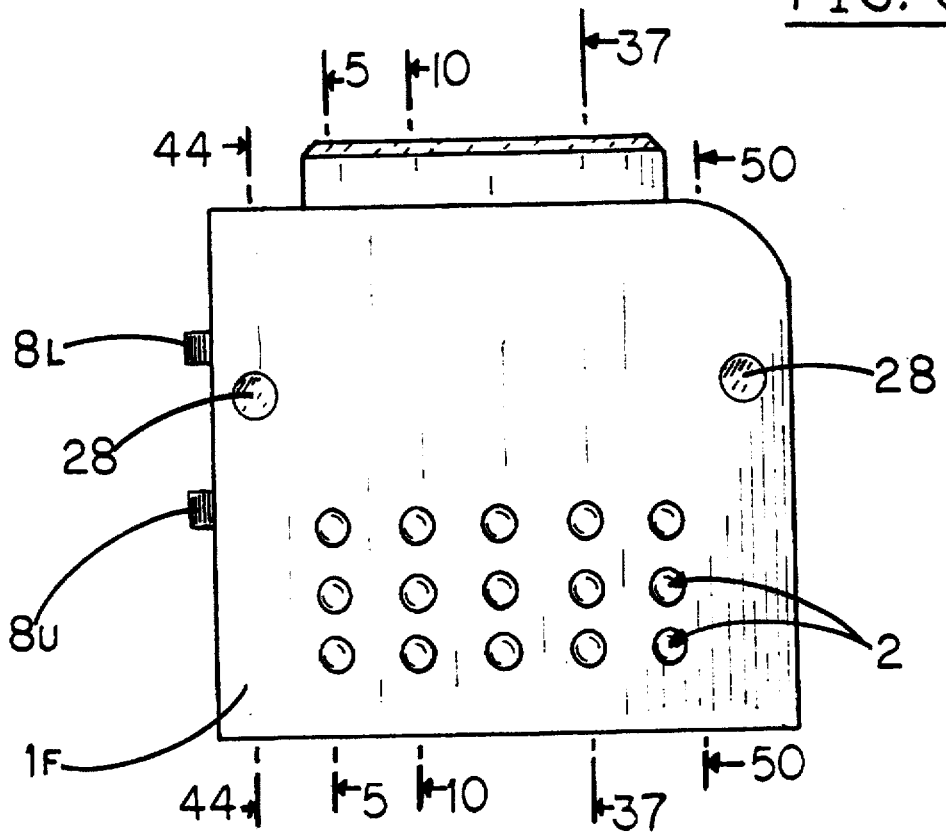
FIG. 3 is a front view of the simplified lock with optional features and reference line indicators for other figures.

FIG. 37 is a fragmented upper sectional view, on line 37—37 of FIG. 3, of the alternative wedging block attached to the rear housing.

Figure 38:
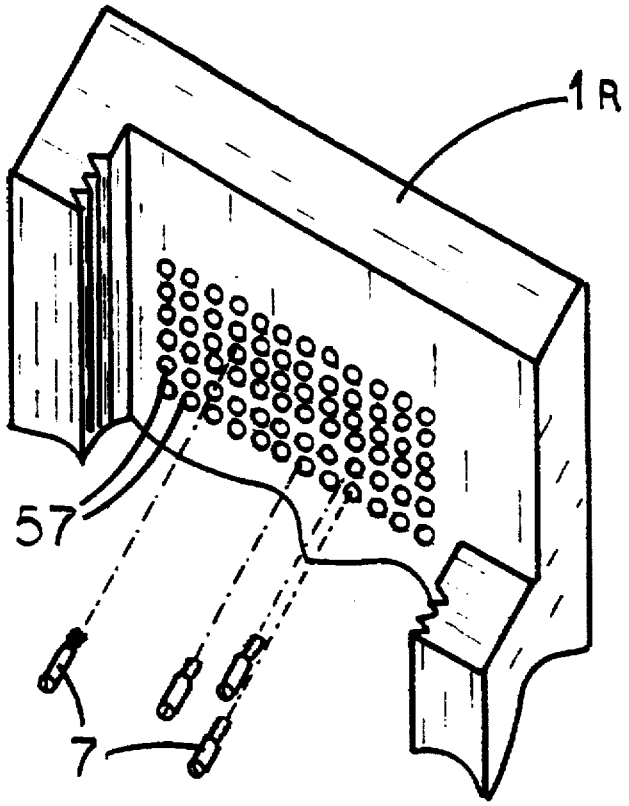

FIG. 38 is a fragmented upper inside isometric view of an alternative trigger guard to lock mounting means.

Figure 39:
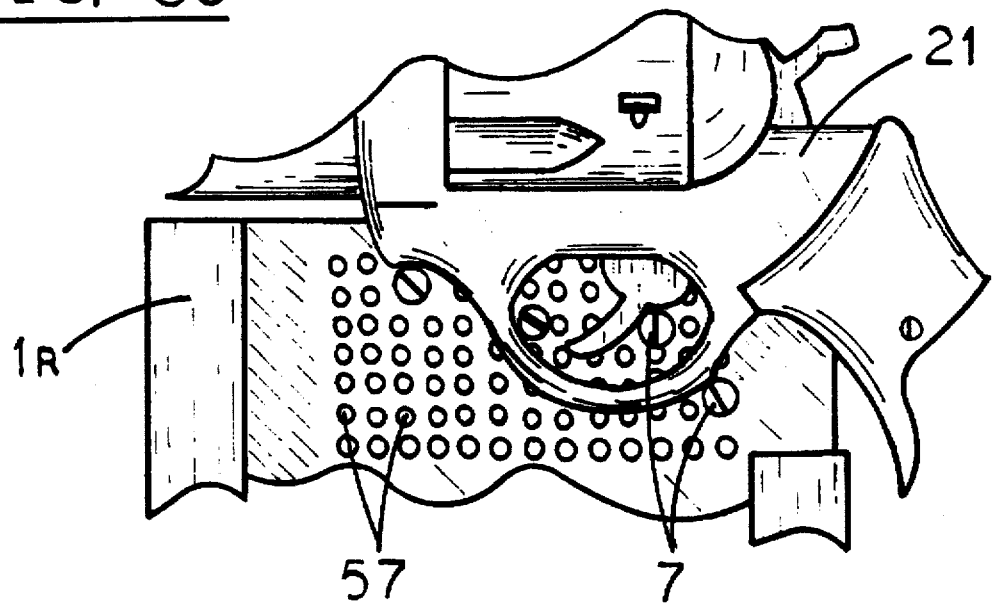

FIG. 39 is a fragmented upper inside view of the alternative trigger guard mounting means.

FIG. 40 is a fragmented upper inside exploded view of an optional latch assemblage.

FIG. 40*a* is a close side view of the latch mounting screw

FIG. 41 is an inside view of optional latches.

FIG. 42 is a side view of the closed latch.

FIG. 43 is a side view of the open latch.

Figure 44:
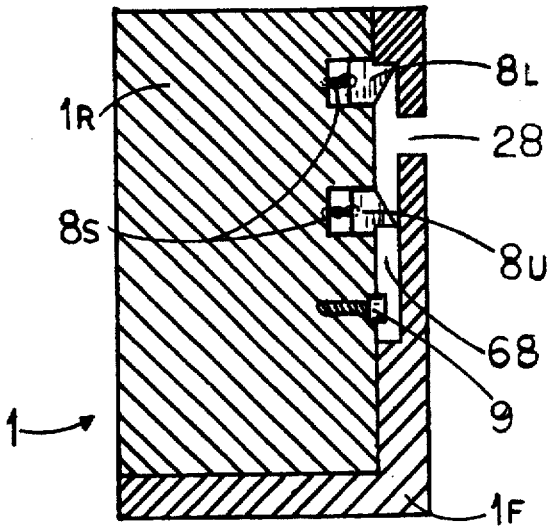

FIG. 44 is a sectional view, on line 44—44 of FIG. 3, of the optional latches and stop.

Figure 45:
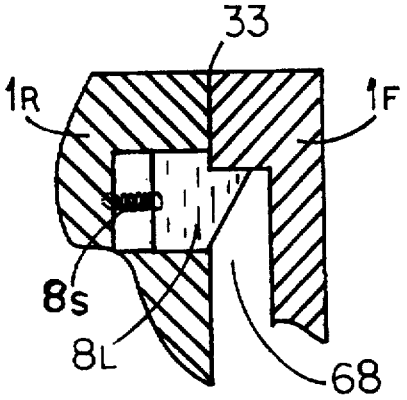

FIG. 45 is a fragmented upper sectional view of the front and rear housing, on line 44—44 of FIG. 3, with the closed latch.

Figure 46:
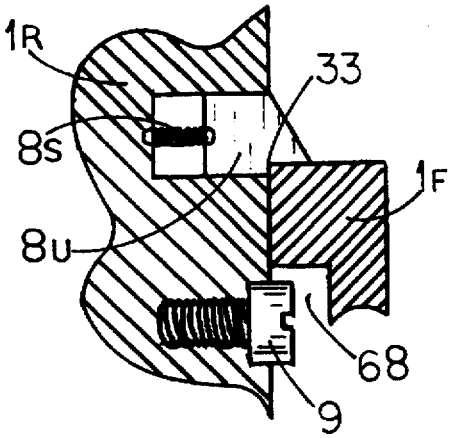

FIG. 46 is a fragmented upper sectional view, on line 44—44 of FIG. 3, of the front and rear housings with open latch and stop screw.

Figure 47:
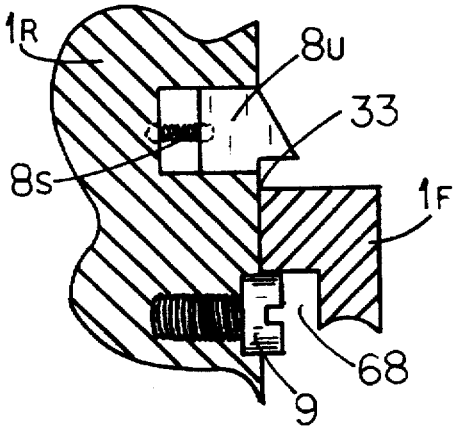

FIG. 47 is a further sectional view, on line 44—44 of FIG. 3, of the open latch and stop screw.

Figure 48:
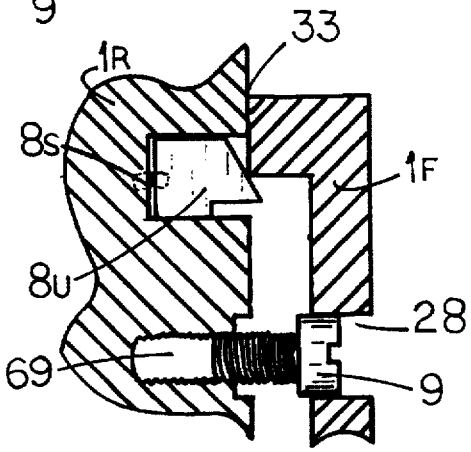

FIG. 48 is an additional sectional view, on line 44—44 of FIG. 3, of the open latch and stop screw.

Figure 49:
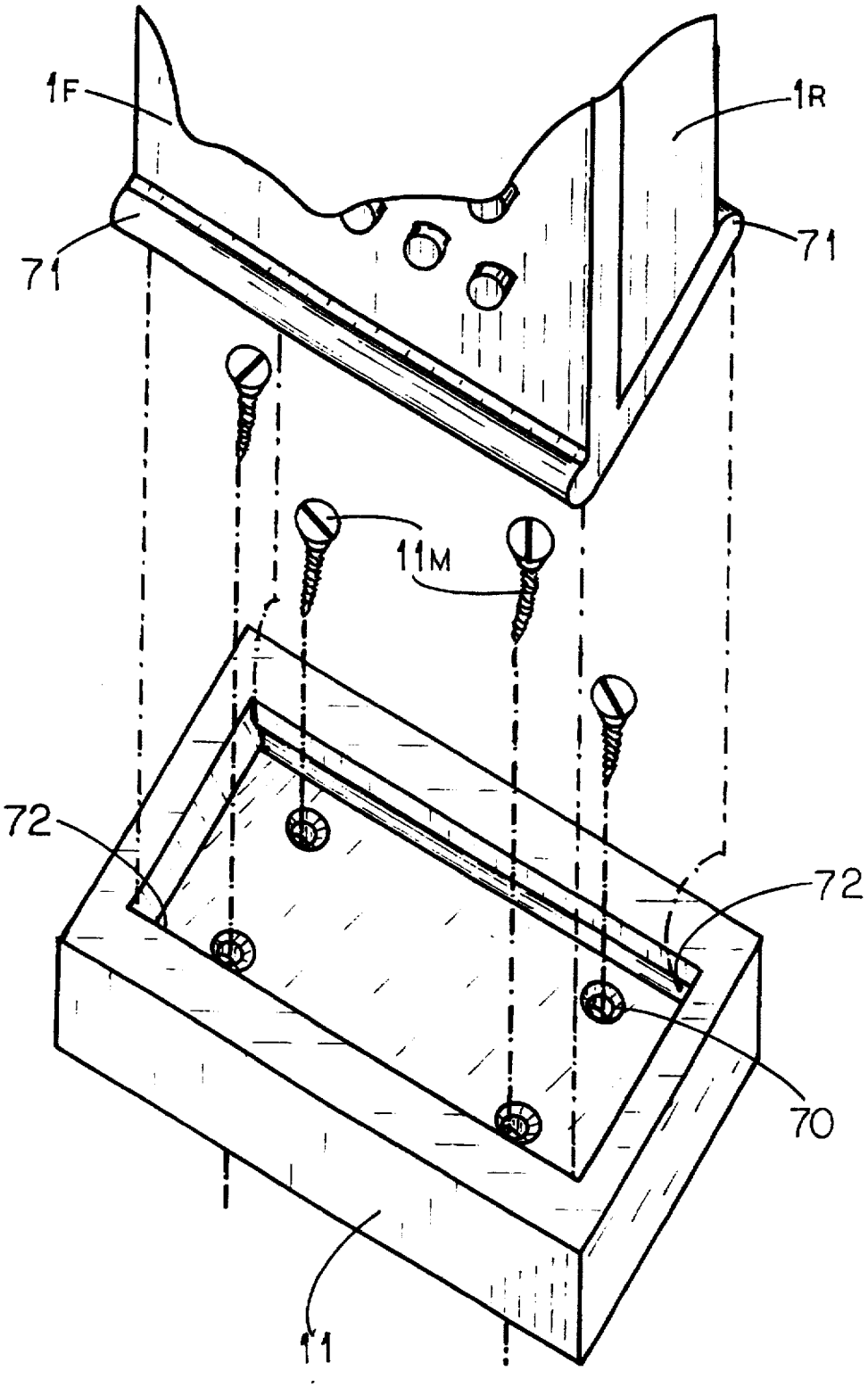

FIG. 49 is a fragmented exploded view of the lower lock assemblage and optional surface mounting bracket.

Figure 50:
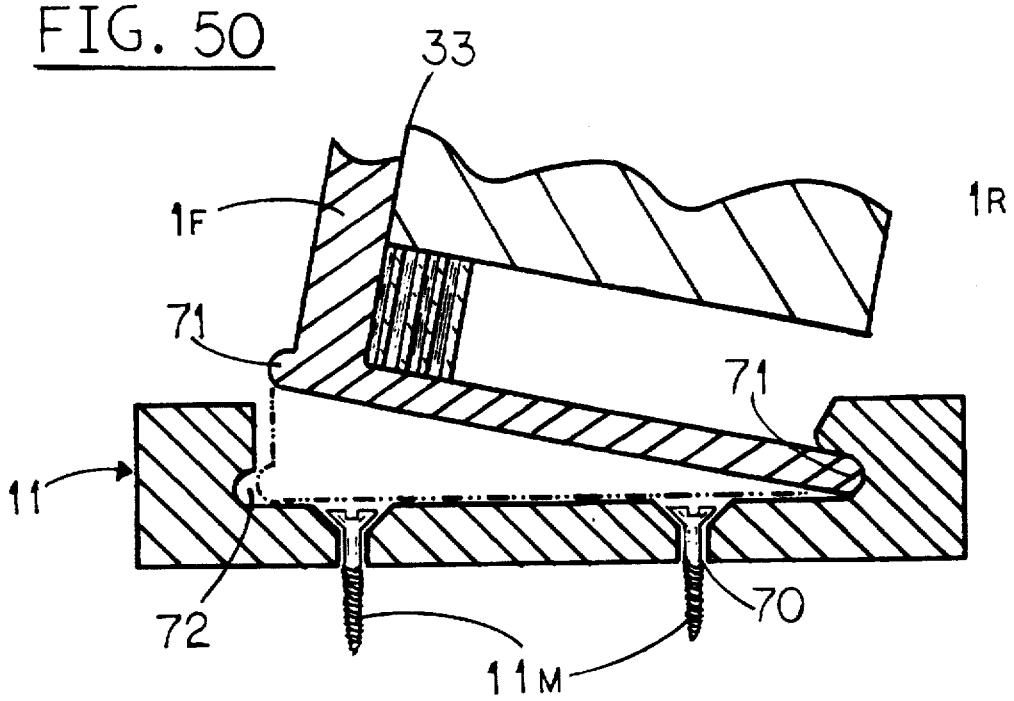

FIG. 50 is a sectional view, on line 50—50 of FIG. 3, of the lock assemblage and the optional surface mounting bracket.

Figure 51:
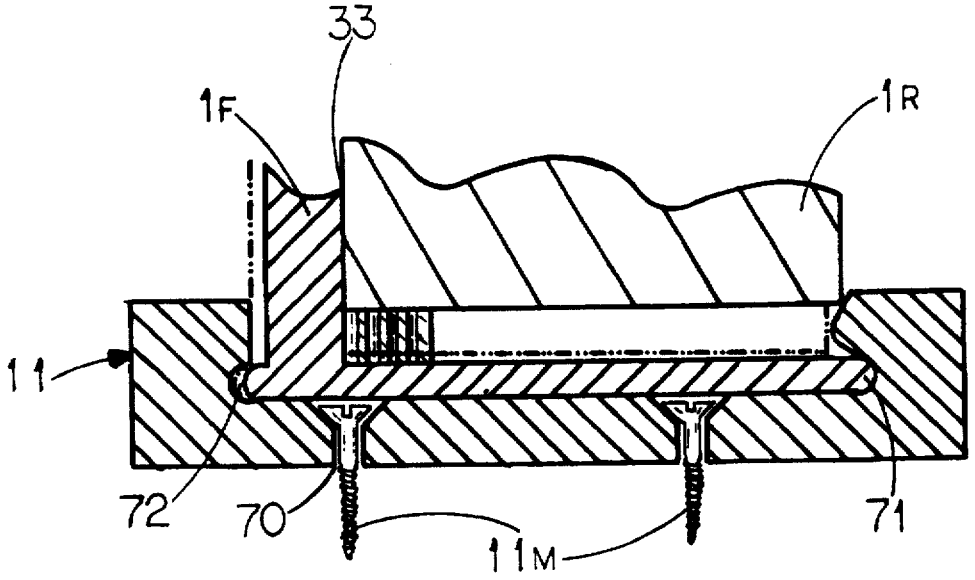

FIG. 51 is an additional sectional view, on line 50—50 of FIG. 3, of the lower lock assemblage and surface mounting bracket.

DETAILED DESCRIPTION—FIG. 1 to 51

Note. All drawings portray the lock in the unlocked condition, except FIG. 11 which displays the lock assemblage in the locked condition.

Figure 1:
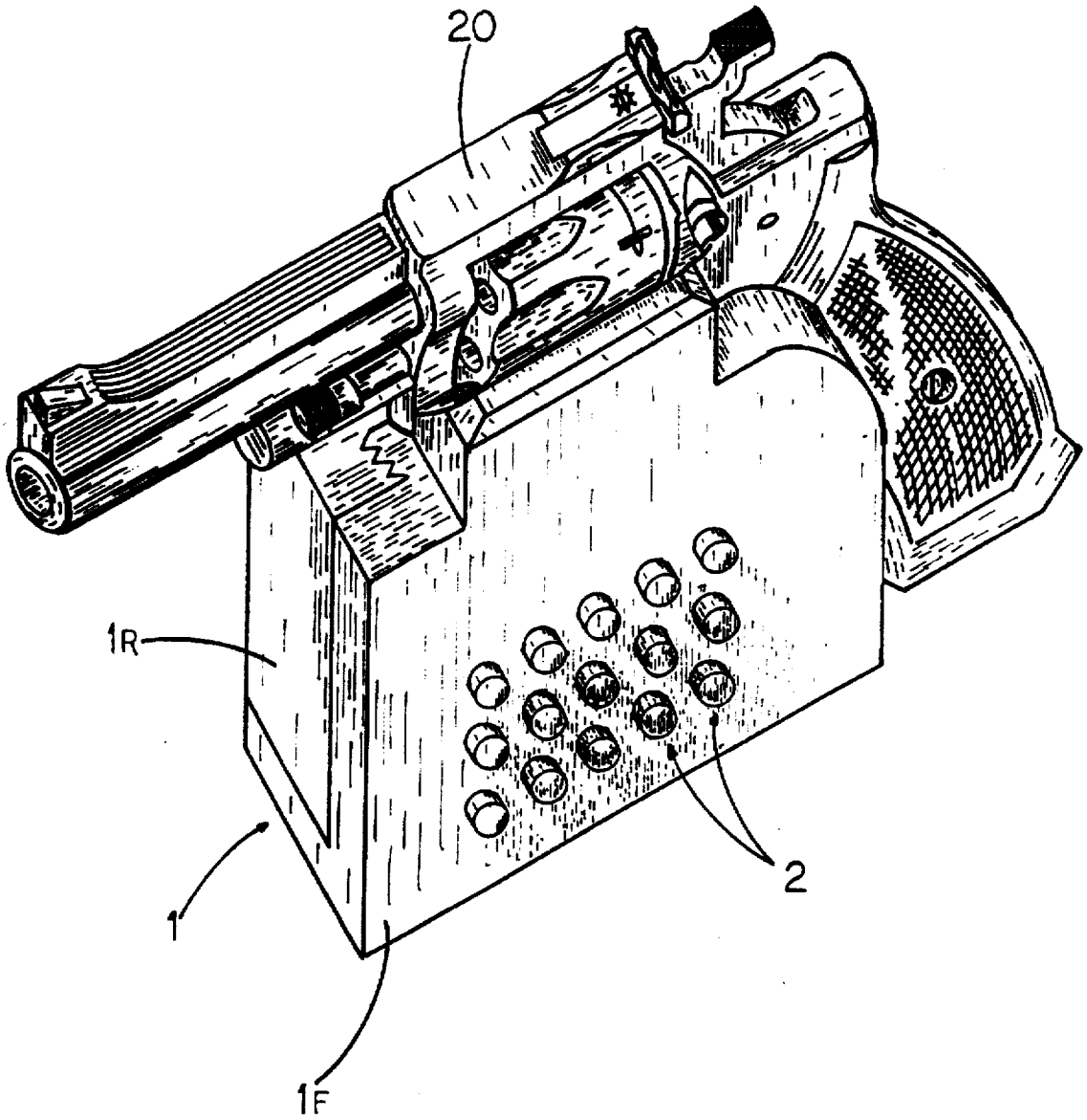
FIG. 1 shows a front view of the simplified firearm lock assemblage with a typical double action firearm housed therein, in the closed condition.
Figure 2:
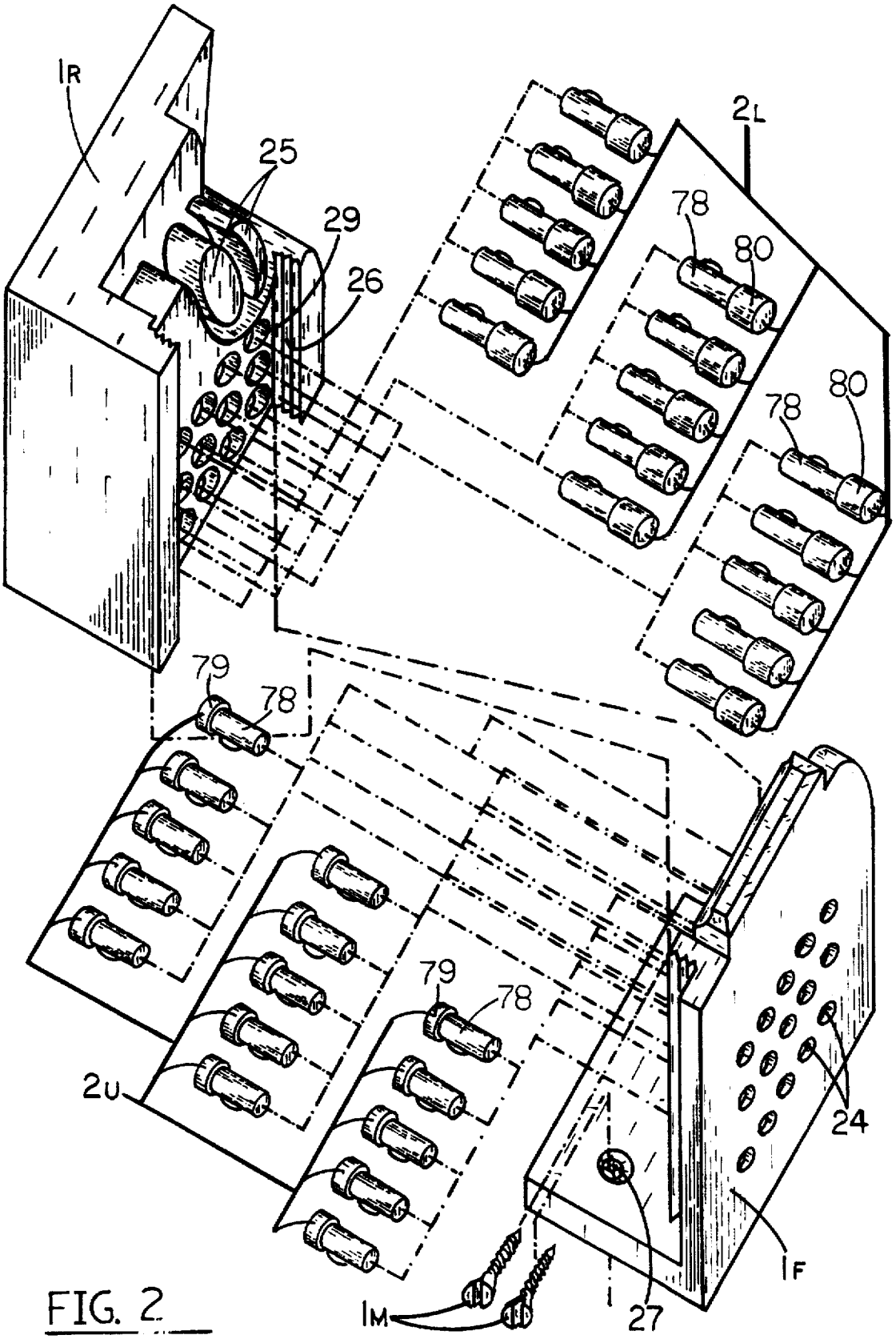
FIG. 2 is an exploded view of the simplified lock
Figure 4:
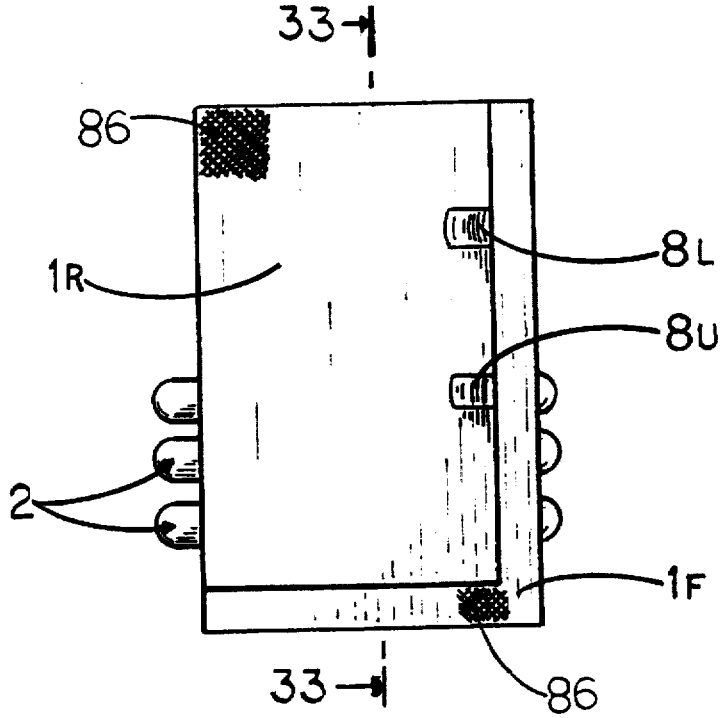
FIG. 4 is a left side view of the lock shown in FIG. 3.
Figure 5:
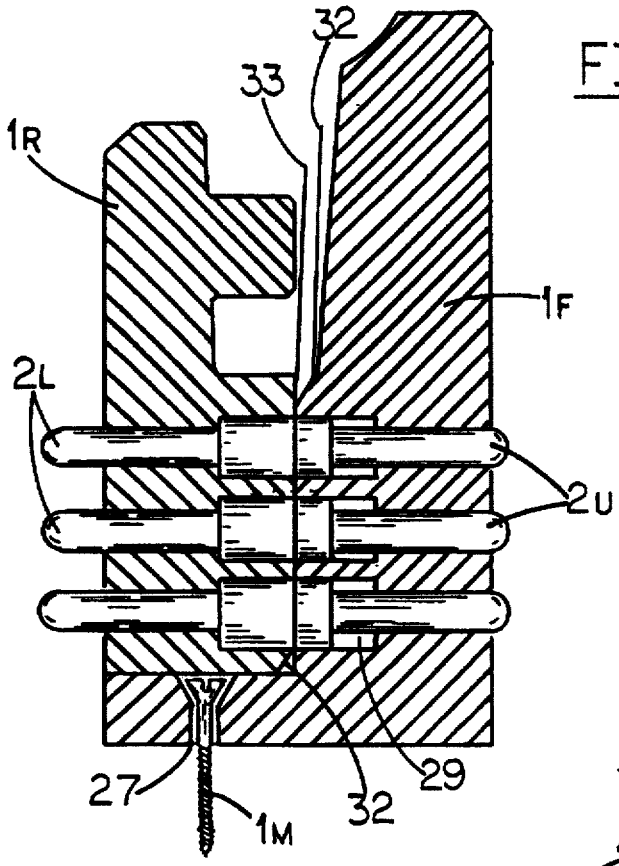
FIG. 5 is a sectional view, on line 5—5 of FIG. 3, of the simplified lock assemblage with disclosure of pin operation, within the housing, and means for housing surface mount.
Figure 6:
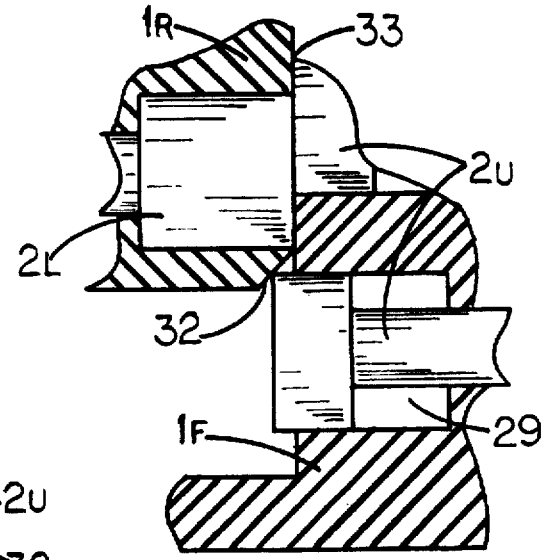
FIG. 6 is a fragmented sectional view of the lower middle portion of the lock assemblage, on line 5—5 of FIG. 3, disclosing a pin ramp.
Figure 7:
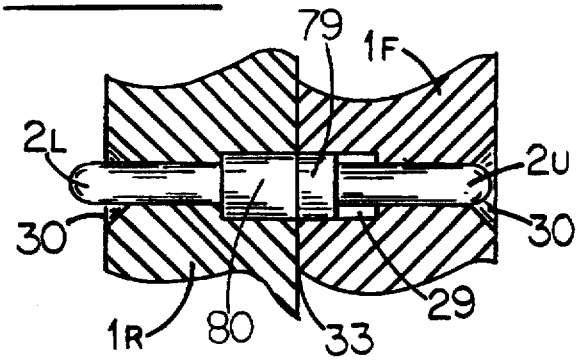
FIG. 7 is a fragmented sectional view of a single pin set in the lock housing, on line 5—5 of FIG. 3, with alternative beveled pin opening.
Figure 8:
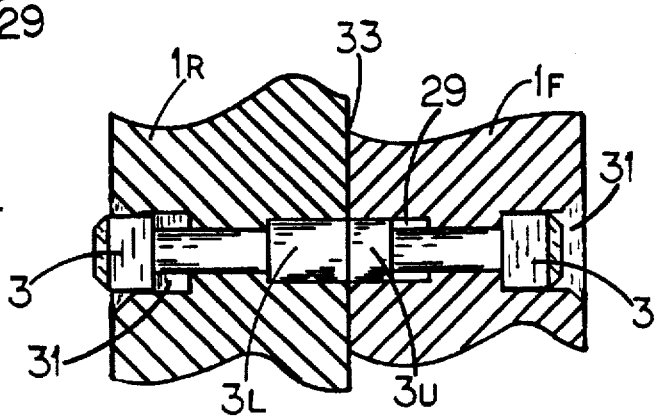
FIG. 8 is a fragmented sectional view, on line 5—5 of FIG. 3, of an additional alternative pin embodiment with further tamper resistance.
Figure 9:
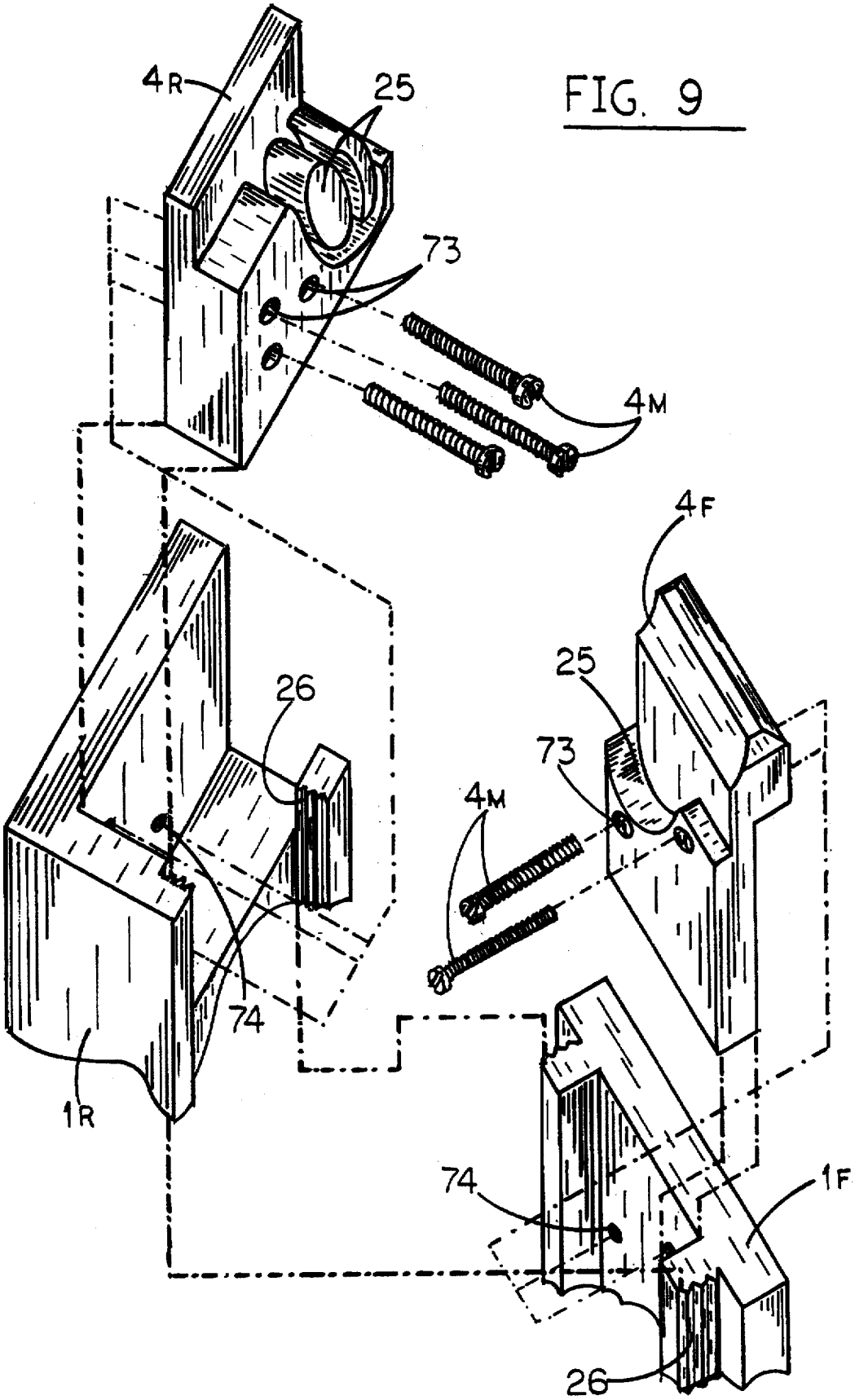
FIG. 9 is a fragmented exploded view of the upper housing with alternative embodiment with use of adapters.
Figure 10:
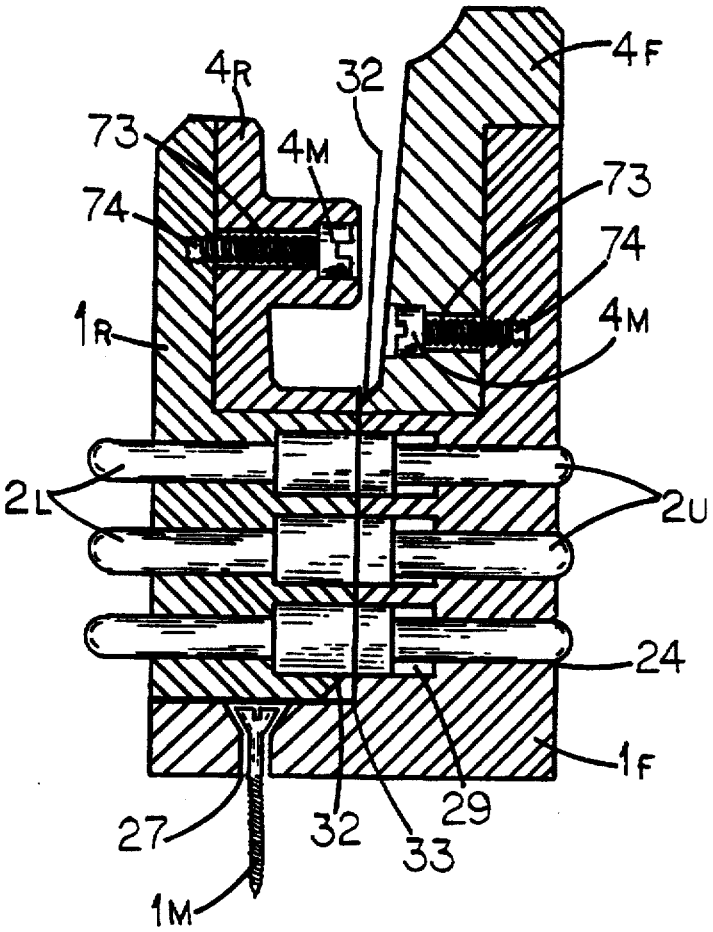
FIG. 10 is a sectional view, on line 5—5 of FIG. 3, of the adapter to housing mounting means.
Figure 11:
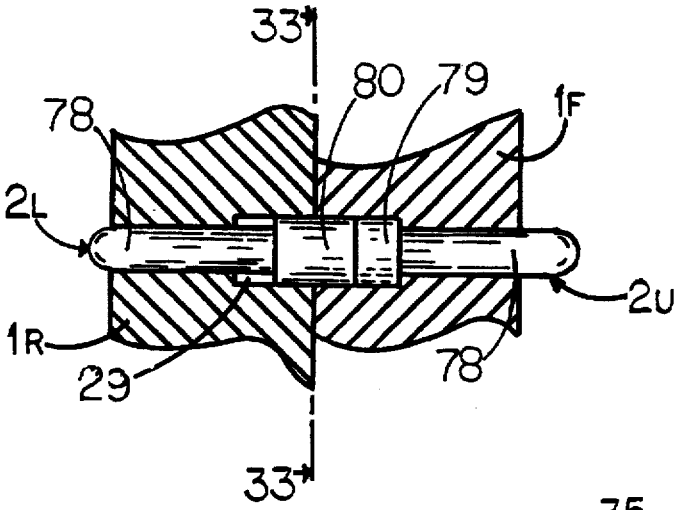
FIG. 11 is a fragmented sectional view, on line 5—5 of FIG. 3, of the pin to housing correlation in the locked position.
Figure 12:
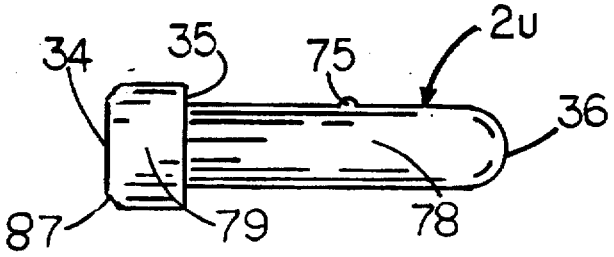
FIG. 12 is a side view of the simplified unlocking pin with position maintaining means.
Figure 13:
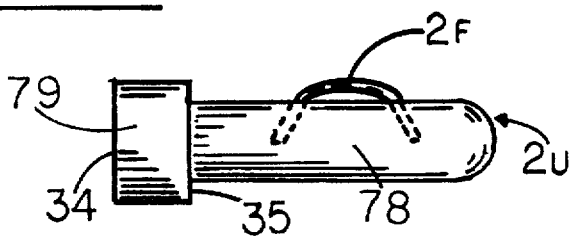
FIG. 13 is a side view of the simplified unlocking pin with alternative position maintaining means.
Figure 14:
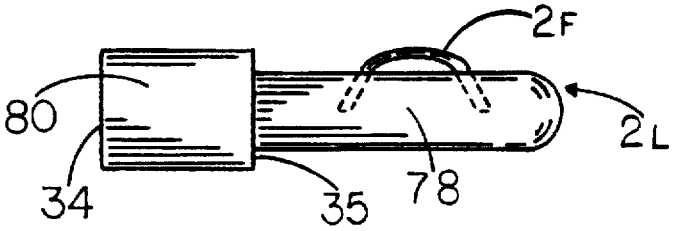
FIG. 14 is a side view of a simplified locking pin with alternative position maintaining means.

A typical embodiment of the push button firearm lock is displayed in FIG. 1 (isometric view), FIG. 2 (exploded view), FIG. 3 (front view), and FIG. 4 (left side view). FIG. 1 illustrates the lock assemblage 1, consisting of a front housing 1F, a rear housing 1R, containing a plurality of pin sets 2, and is closed on a typical double action revolver 20. A pin set consists of a locking pin 2L and an unlocking pin 2U as shown in FIG. 2 and FIGS. 10 through 14. Further, FIG. 2 discloses said front 1F and rear 1R housings containing a plurality of stepped apertures to accommodate said locking 2L and unlocking 2U pins. Said stepped apertures consist of the outer portion of the aperture 24, in which the inside diameter is accommodating to the outside diameter of the pin stem 78, and the inner portion of the stepped aperture 29, in which the inside diameter is accommodating to the outside diameter of the locking pin head 80, or the unlocking pin head 79. The depth of the pin head aperture 29, is equivalent to the length of the locking pin head 80. The pin head aperture 29 is always greater in diameter than the pin stem aperture 24, thus allowing the pin head diameter differential 35 to stop the outward travel, of the pins 2L or 2U. This also causes the inside end of locking pin head 34, as illustrated in FIG. 14, to stop in a conjunctive manner with the shear line 33. The length of the stem aperture 24 is the remaining distance between the pin head aperture 29 and the outside face of the rear housing 1R. The stem aperture 24 length is equivalent in both the front 1F and rear 1R housings. The pin stem aperture 24 and the pin head aperture 29 are both positioned based on the same centering point such as a countersunken bore. All of the pin apertures are equivalent in nature. The length of the unlocking pin head 79 must be shorter than the length of the locking pin head 80. The difference in the length of the locking pin head 80, and the unlocking pin head 79, is equivalent to the allowable distance traveled by the pin set 2 within the housing 1. Therefor the pin set 2 travel distance may be altered by adjusting the length of the unlocking pin head 79, the length of the locking pin head 80, and or their length ratio. The length of all the pin stems 78 is equivalent to the length of the pin stem aperture 24 plus the length, of the difference in length, of the unlocking pin head 79 and the locking pin head 80. The length of the pin stem 78 that protrudes beyond the outside face of either the front 1F or the rear 1R housings, when the pins are fully inserted into their respective apertures, must be the same or greater length than the difference in length of the locking pin head 80 add the unlocking pin head 79. For the purpose of this illustration, the rear housing 1R contains all of the locking pins 2L and the front housing IF contains all of the unlocking pins 2U. As a result, the illustrated firearm lock of FIG. 2, can be unlocked by depressing all of the front pins as will be discussed in more detail. Further, as a benefit of these dimensional relationships, it is possible to rotate a pin set 2 end over end, without modifying the housing, thereby changing the combination. Additionally, FIG. 2 illustrates the separation and installment of the front housing IF to the rear housing 1R. Once the locking pins 2L are inserted into the rear housing 1R and the unlocking pins 2U are inserted into the front housing 1F, the front housing 1F can be installed into the rear housing 1R by aligning them on their corresponding housing tracks 26. Once the housing halves 1F and 1R are initially installed together, on said housing track 26, but only overlapping by approximately half of their structure, a firearm may be placed into a trigger guard mount 25. Said trigger guard mount 25 is located in the upper inside face of the rear housing 1R. The trigger guard mount 25 is a projection of the rear housing 1R. After installation of a firearm into the trigger guard mount 25, the housing halves 1F and 1R may be closed completely around the firearm. The lock assemblage 1 may now be locked by depressing all or part of the locking pins 2L, in the rear housing 1R, and thereby moving half of the locking pin head 80, across the shear line 33, into the pin head aperture 29 of the front housing 1F. This affect is further illustrated in FIG. 11. Optionally the front housing 1F may be attached to a stationary surface by installing the mounting screws 1M, through the surface mounting apertures 27, to a desired surface. Additionally, with the omission of the pin sets and complimentary apertures, the lock can be used as a firearm display only. FIG. 3 and FIG. 4 disclose a front and left side view of the lock assemblage with optional features including; a closed latch 8L, an open latch 8U, a stop screw access aperture 28, and digit grips 86. Said digit grips 86 are provided for easier separation of the front and rear housings 1F and 1R. The digit grips are located in the upper left and right sides of the rear housing 1R, to correspond with one hand, and in the lower left and right sides of the front housing 1F, to correspond with the other hand. FIGS. 3 and 4 also disclose reference lines 33—33, which is the interior shear line of the lock, also detailed are lines 5—5, 10—10, 37—37, 44—44, and 50—50 which are used in the location of sectional drawing of the corresponding number. FIG. 5 is a sectional view of the preferred simplified lock assemblage 1, on line 5—5 of FIG. 3, with the locking and unlocking pins 2L and 2U in the unlocked condition and also discloses the location of an optional pin repositioning ramp 32. Said optional repositioning ramp 32 is configured into the upper inside face of the front housing 1F, and the lower inside face of the rear housing 1R for the purpose of pushing the locking or unlocking pins 2L or 2U, back into the pin head apertures 29, in the event the pin stems 78 are depressed when the lock is in the open condition. FIG. 6 is a larger fragmented sectional view, on line 5—5 of FIG. 3, of the lower inside portion of the rear housing IR with a locking pin 2L installed, and the lower inside portion of the front housing 1F with an unlocking pin 2U. The unlocking pin 2U has been pushed from the outside until it would obstruct the housing halves 1R and 1F from closing without the pin reposition ramp 32 in place. FIG. 7 is a fragmented sectional view, on line 5—5 of FIG. 3, of an alternative pin stem aperture embodiment 30. The lock assemblage 1 can be unlocked by pulling all of the locking and unlocking pins 2L and 2U outward and thereby eliminating any of the locking pin heads 80 from being positioned across the shear line 33. This activity can be discouraged by recessing the pin stems 78 in the pin stem aperture 24 with an outer beveled opening 30 and shortening the pin stems 78. FIG. 8 continues on this subject with an additional fragmented sectional view, on line 5—5 of FIG. 3, of a further tamper proof alternative embodiment. Elimination of the ability for the lock assemblage 1 to be unlocked can be achieved by substituting the locking and unlocking pins 2L and 2U with a tamper resistant stem and button 3 combined with tamper resistant locking head 3L, and a tamper resistant stem and button 3 combined with a tamper resistant unlocking head 3U. It is also necessary to outfit the outer faces of the front and rear housings 1F and 1R with a complimentary recessed opening 31 to accommodate the button portion of the tamper resistant button and stem 3. FIG. 9 is a fragmented exploded view of the upper portions of the front and rear housing IF and 1R with an alternative firearm mounting adapter embodiment. A rear housing adapter 4R is mounted to the rear housing 1R with adapter mounting screws 4M through adapter mounting holes 73 into accommodating housing threaded mounting holes 74. Likewise, a front housing adapter 4F is mounted to the front housing 1F with said adapter mounting screws 73 through said adapter mounting holes 74 into said accommodating housing threaded mounting holes 74. The firearm is installed into the firearm mount 25 of the rear housing adapter 4R, in the same manner as a firearm is installed into the firearm mount 25 of the rear housing 1R of the non adapter type housing. FIG. 10 is a sectional view, on line 5—5 of FIG. 3, disclosing the adapter to housing mounting relationship. FIG. 11 is a fragmented sectional view, on line 5—5 of FIG. 3, disclosing the locking and unlocking pins 2L and 2U in the locked condition. Locking pin 2L has been pushed from the rear housing 1R side of the lock toward the front housing 1F side thereby placing the locking pin head 80 over the shear line 33 rendering the housing halves 1F and 1R unable to be separated. Additionally, this condition has also pushed the unlocking pin 2U toward the front of the lock and has made the pin stem 78 of the unlocking pin 2U available to be depressed. FIG. 12 is a closer side view of the preferred simplified unlocking pin 2U. Shown are various features including; the flat end 34 of the unlocking pin head 79, the diameter differential 35 of the pin stem 78 and the unlocking pin head 79, the rounded end 36 of the pin stem 78, and a friction projection 75 that is utilized to maintain the position of the locking or unlocking pins 2L and 2U, thereby preventing the pins from falling out of the lock, in the event it is held horizontally while in the open condition. Further disclosed is an optional pin head beveled edge 87, located on the interior flat end 34, of the locking or unlocking pin head.

Figure 18:
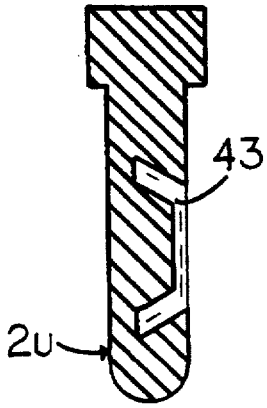
FIG. 18 is a sectional view, on line 18—18 of FIG. 19, of an alternative position maintaining means opening.
Figure 15:
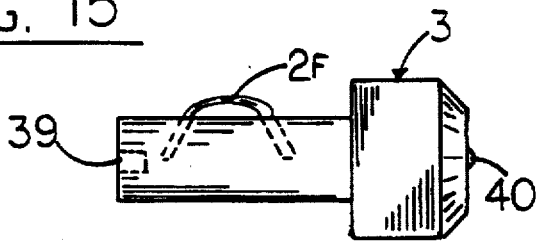
FIG. 15 is a side view of a tamper resistant pin button and stem including alternative position maintaining means.
Figure 19:
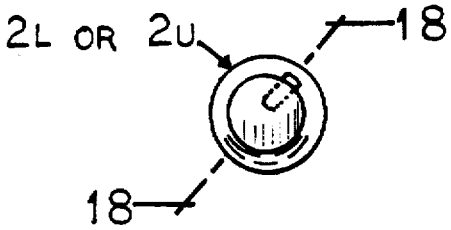
FIG. 19 is an outside end view of a simplified locking or unlocking pin.
Figure 16:
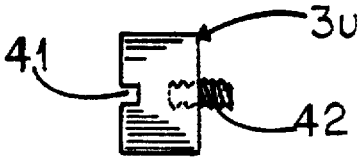
FIG. 16 is a side view of an unlocking head and attachment means for use with the tamper resistant pin button and stem.
Figure 20:
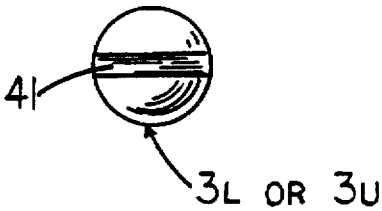
FIG. 20 is an inside end view of locking or unlocking head used with the tamper resistent pin button and stem.
Figure 17:
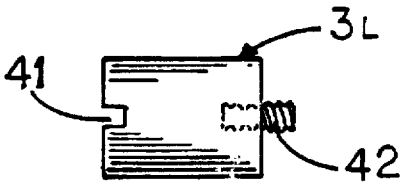
FIG. 17 is a side view of a locking head used with the tamper resistant button and stem.
Figure 21:
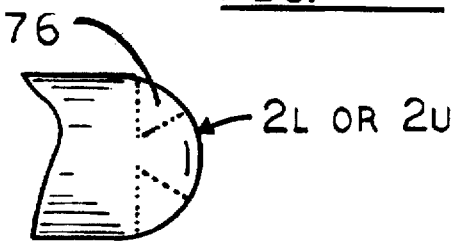
FIG. 21 is a fragmented side view of the outside end of a simplified locking or unlocking pin with unlocking means.
Figure 22:
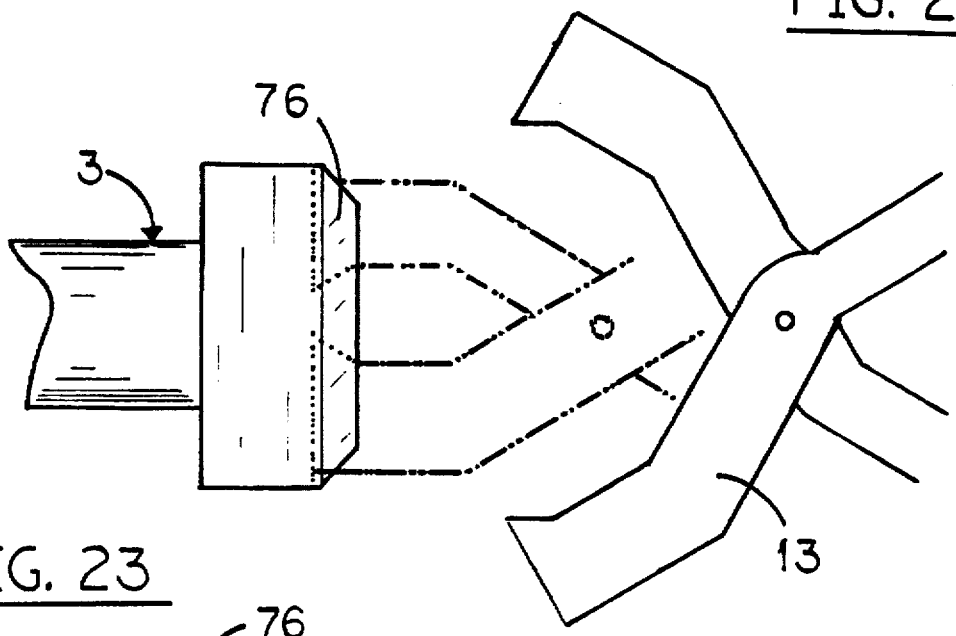
FIG. 22 is a fragmented side view of a tamper resistent pin button and stem when using unlocking means.
Figure 23:
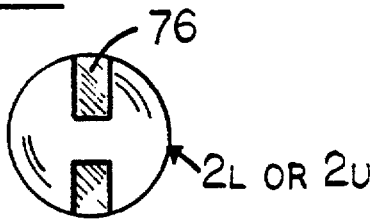
FIG. 23 is an outside end view of a simplified locking or unlocking pin with unlocking means.
Figure 24:
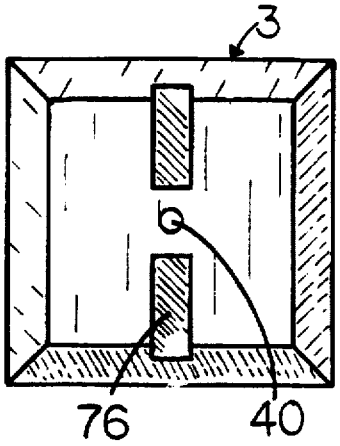
FIG. 24 is an outside end view of a tamper resistent pin button with unlocking means.
Figure 25:
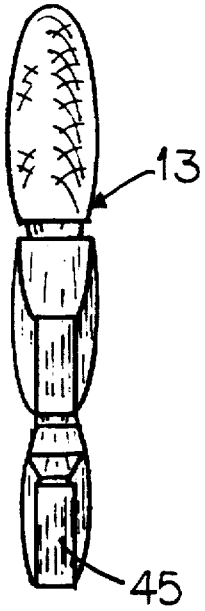
FIG. 25 is an end view of a corresponding unlocking tool.
Figure 26:
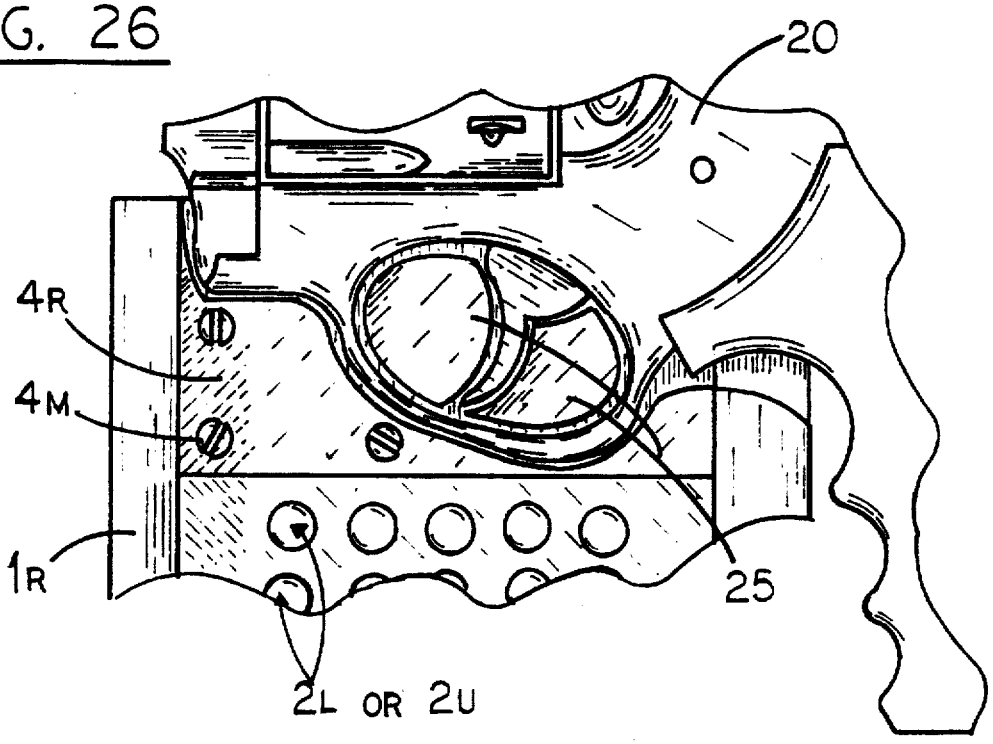
FIG. 26 is a fragmented inside view of the rear housing with trigger guard mounting, adapter mounting and a typical double action revolver installed therein.
Figure 27:
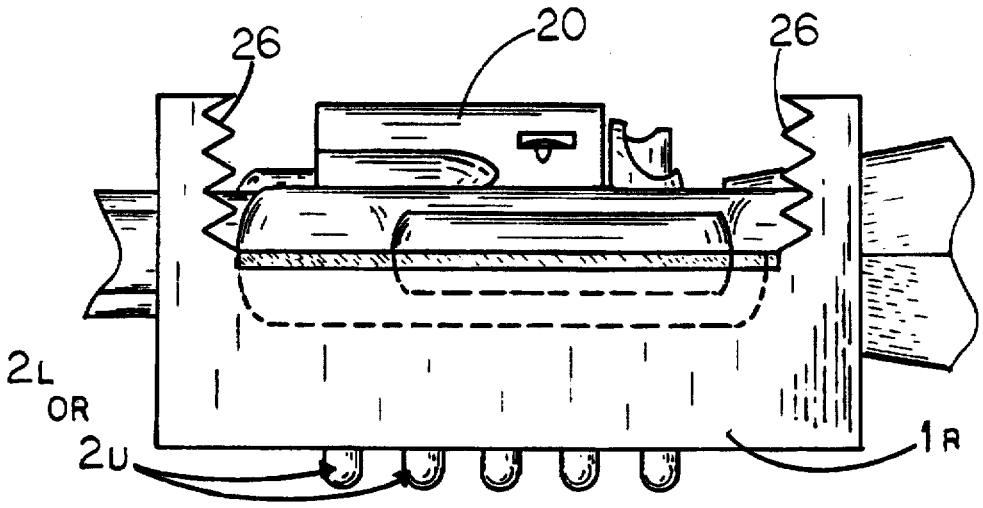
FIG. 27 is an underside view of the rear housing with a typical double action revolver installed therein.
Figure 28:
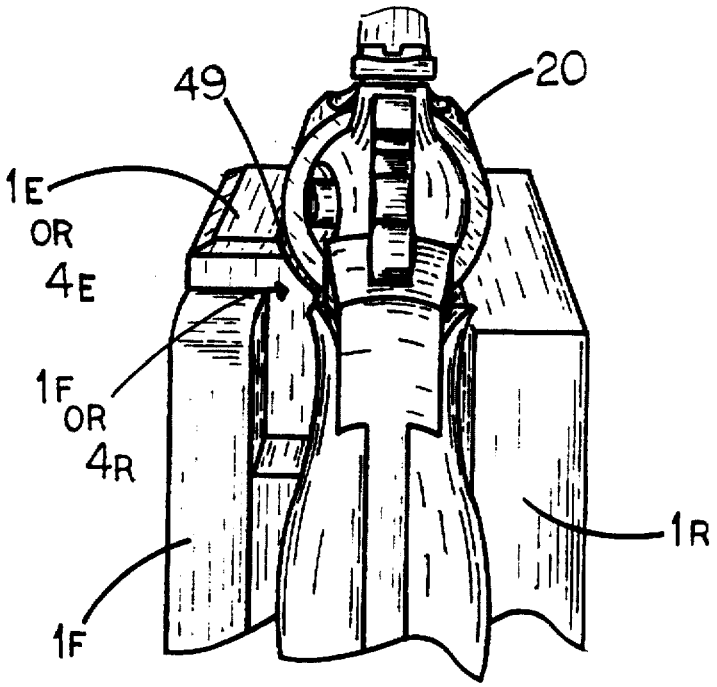
FIG. 28 is a fragmented rear view of the upper lock assemblage with a typical double action revolver installed therein.
Figure 29:
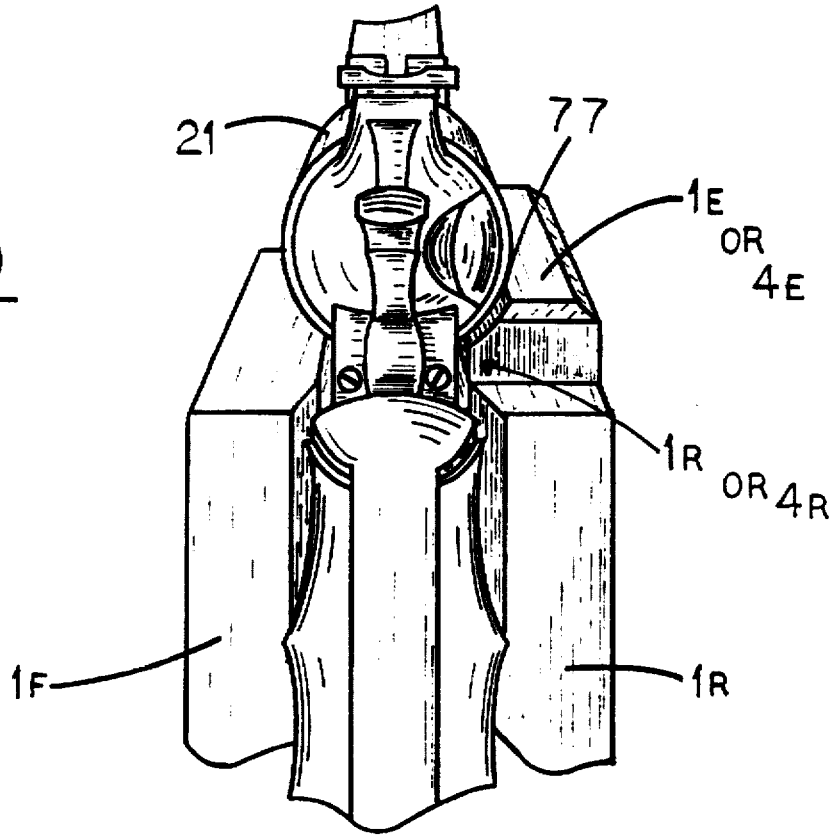
FIG. 29 is a fragmented rear view of the upper lock assemblage with a typical single action revolver installed therein.

Said beveled edge 87 can be employed to allow easier opening of the lock or to decrease the demand for extremely close tolerances with regard to the construction of the housing halves 1F and 1R. Further, interior flat end 34 can be constructed in a convex manner with or without the beveled edge 87. This also would create the same affect. The same features are employed in the preferred simplified locking pin 2L except the locking pin head 80 is double the length of the unlocking pin head 79 as is shown in FIG. 13 and FIG. 14. The unlocking pin 2U of FIG. 13 is depicted in proportion to the locking pin 2L of FIG. 14. Also revealed, is the use of an alternative pin friction device 2F that can be substituted for the friction projection 75. FIG. 15 is a closer side view of the tamper resistant pin stem and button 3 with alternative friction device 2F installed, threaded pin head mounting hole 39, and an optional haptic projection 40 on the face of the button portion of the pin stem and button 3. Said haptic projection allows the user of the lock to feel the buttons more easily when operated in the dark. FIG. 16 and FIG. 17 are closer side views of the tamper resistant unlocking head 3U and the tamper resistant locking head 3L which are depicted in proportion. The length of the unlocking head 3U is one half the length of the locking head 3L and both contain similar features. The features, of the tamper resistant pin heads 3L and 3U shared are; a head installation slot 41, and a threaded mounting stud 42 that installs into the complimentary mounting hole 39 of the pin stem and button 3 shown in FIG. 15. FIG. 18 is a sectional view, on line 18—18 of FIG. 19, showing the alternative friction device notch 43 that is accommodating to the alternative friction device 2F. FIG. 19 is an outside end view of a simplified pin 2U or 2L with an alternative friction device installed within and the sectional reference line 18—18 use for FIG. 18. FIG. 20 is an inside end view of the tamper resistant locking or unlocking head 3L or 3U showing the installation slot which is complimentary to the end of a flat tipped screw driver. FIG. 21 is a fragmented side view of the end of a simplified locking or unlocking pin 2L or 2U disclosing the use of an unlocking embrasure 76. In the event the combination of the lock is forgotten, and either of the tamper resistance means are employed, it would be necessary to provide a means for unlocking the lock. FIG. 22 is a fragmented side view of the tamper resistant pin stem and button 3 utilizing the unlocking embrasure 76 with a corresponding unlocking tool 13. FIG. 23 is an outside end view of the simplified pin stem 78 of either a locking or unlocking pin 2L or **2*u*, displaying the unlocking embrasure 76. FIG. 24 is an outside end view of the tamper resistant pin stem and button 3, utilizing the unlocking embrasure 76, and said haptic projection 40. FIG. 22 is an end view of said corresponding unlocking tool 13. FIG. 26 is a fragmented inside view of the upper portion of the rear housing 1R with the alternative rear firearm mounting adapter 4R, fastened with the mounting screws 4M, and a typical double action revolver 20, placed in the complimentary trigger guard mount 25. FIG. 27 is an underside view of the rear housing 1R showing the rear housing side of the housing track simplified locking or unlocking pins 2L or 2U installed, and a typical double action revolver 20 mounted therein. FIG. 28 is a fragmented upper rear view of the lock assemblage 1, in the closed condition, with a typical double action revolver 20 installed therein. Also shown is the use of a housing extension portion 1E of the front housing 1F or the adapter extension portion 4E of the front adapter 4F, as it is used to block access to the ammunition of the installed double action firearm 20, with a mating cylinder concavity 49. FIG. 29 is a fragmented upper rear view of the lock assemblage 1, in the closed condition, with a typical single action revolver 21 installed therein. Also shown is the use of said housing extension portion 1E of the rear housing 1R or adapter extension portion 4E of the rear adapter 4R, as it is used to block access to the ammunition opening of the installed single action revolver 21, with a mating cylinder concavity 77. FIG. 30 is a fragmented upper rear view of the lock assemblage 1, in the closed condition, with a typical semi-automatic firearm 23 installed therein. Also shown is the use of the housing extension portion 1E of the rear housing 1R or the rear adapter extension portion 4E of the rear adapter 4R as it is used to surround the shell casing ejection port, of said typical semi automatic firearm 23 and thereby preventing the slide portion of the semi-automatic firearm 23 from movement. This feature is further illustrated in FIG. 31. A shell casing ejection port projection 46 of either the rear housing extension 1E or the rear adapter extension 4E is provided for insertion into the slide portion of the semi-automatic firearm 23. FIG. 32 is a fragmented lower right inside view of the rear housing 1R disclosing the disposition of a magazine blocking projection 4P as it prevents access to the ammunition of the semi-automatic firearm 23. This projection can either be an integral part of the rear housing 1E or can be separable as shown in FIG. 32*a*. Said magazine blocking projection 4P is mounted to rear housing 1R, with projection screws 81, that are inserted through projection holes 82, enabling threading into housing holes 83. FIG. 33 is a fragmented upper inside view of the rear housing 1E with or without the use of an adapter. Disclosed is an alternative embodiment of the rear housing extension 1E or the rear adapter extension 4E with an alternative slide projection 47 enabling the lock to block access to the slide of a semi-automatic firearm, in which there is no shell casing ejection port used. FIG. 34 is a fragmented upper inside view of an alternative hammer projection 48 used with either the rear housing extension 1E or the rear adapter extension 4E in which the access to the hammer of a firearm, such as a semi-automatic pistol or a lever action rifle can be achieved. FIG. 35 is a fragmented upper inside view of the rear housing 1R with an alternative multiple firearm wedging means. A wedging block 6R fitted with a meshing edge 55, which is inserted into a complimentary joint slot 54, in the rear housing 1R, and held outward with a tension spring 6S. Said tension spring 6S is inserted into a complimentary spring aperture 51. Said wedging block 6R is adjustable inward with a cone shaped wedging screw Said wedging screw 6W is installed between the complimentary rear housing slot 53, and a cone groove 56, located on the rear housing side of the wedging block 6R, as FIG. 36 discloses. FIG. 37 is a fragmented upper view of the rear housing 1R with said alternative wedging means, on line 37—37 of FIG. 3, illustrating the wedging components in the assembled condition. A mirrored wedging means can be utilized on the front housing also. This alternative wedging means would be generally used in conjunction with the alternative trigger guard mounting arrangement of FIGS. 38 and 39. FIG. 38 is a fragmented upper inside isometric view of the rear housing wherein a plurality of threaded apertures 57 are complimented with a plurality of threaded trigger guard mounting pins 7, which enables numerous firearm mounting capabilities. FIG. 39 is a fragmented upper inside view of the rear housing employing said threaded apertures 57 with said mounting pins 7 and a typical single action revolver housed therein. FIG. 40 is a fragmented upper left inside exploded view, of the rear housing, with an optional closed latch 8L. Said closed latch 8L installs into a latch mortise 63, and is movable on pivot pins 61, which inserts into pivot pin mortise 66. The latch 8L** is forced outward in the mortise 63 with a coil spring 8S which installs between the rear housing spring aperture 58 and a latch spring aperture 60, shown in FIG. 41. The closed latch 8L is restricted from exit by a latch mounting screw 8M which is installed into the latch mounting screw threaded aperture 59, located in the rear housing 1R. Said latch mounting shoulder screws 8M are capable of allowing pivoting and latch retention as is disclosed in FIG. 40*a*. An overlapping top step 85 is provided to prevent the closed latch 8L from exit, and the middle overlapping step 84 is provided to retain the latch pivots 61 while still allowing movement. An additional optional latch can be employed, utilizing said latch mounting means, as will be later discussed. FIG. 41 is a rear view of either the optional closed latch 8L or an optional open latch 8U. A latch spring aperture 60 is provided to retain the latch spring 88. FIG. 42 is an inside end view of the optional closed latch 8L, illustrating the closed catch ramp 64. FIG. 43 is an inside end view of the optional open latch 8U, disclosing the open catch ramp 65. FIG. 44 is a sectional view of the lock assemblage I embodying; the optional closed latch 8L, the optional open latch 8U, and the optional front housing stop screw 9, on line 44—44 of FIG. 3. A stop screw slot 68 is provided to allow travel of the front housing 1F downward until it contacts the stop screw 9. A stop screw aperture 28 is also provided to allow installation of the stop screw 9. Further, the closed latch 8L, is depicted in the closed and latched condition against the upper portion of the stop screw slot 68. The stop screw 9 and the open latch 8U preform no function while the lock assemblage 1 is closed. FIG. 45 is a fragmented upper view of the closed latch 8L while the lock assemblage 1 is in closed and latched condition. Also illustrated is the placement of the latch spring 8S. FIG. 46 is a fragmented sectional view, on line 44—44 of FIG. 3. The upper portion of the front housing 1F, and the middle portion of the rear housing 1R are shown containing the optional open latch 8U and stop screw 9. The weight of the rear housing 1R, is at rest on the open latch 8U, as a result of the pressure exerted by latch spring S8, supported on the upper edge of the front housing 1F. The stop screw 9 preforms no function while the housing halves 1R and 1F are in this condition. FIG. 47 is a fragmented sectional view, on line 44—44 of FIG. 3. The upper portion of the front housing 1F and the middle portion of the rear housing 1R are disclosed utilizing the optional open latch 8U and stop screw 9. The front housing 1F is prevented from complete separation from the rear housing 1R, as the upper inside lip of the stop screw slot 68 makes contact with the head of the stop screw 9, therefore, the weight of the front housing 1F is supported by the head of the stop screw 9 that is mounted to the rear housing 1R. The open latch 8U preforms no function while the housing halves 1E and 1F are in this condition. FIG. 48 is a fragmented sectional view, on line 44—44 of FIG. 3, of the upper portion of the front housing 1F and the middle portion of the rear housing 1R, showing the installation of the optional stop screw 9. The optional stop screw 9 is inserted into the rear housing threaded aperture 69, through the stop screw aperture 28, fashioned within the upper portion of the front housing 1F. Also shown is the open latch 8U in the partially depressed condition. The open latch 8U performs no function while the front and rear housing halves 1F and 1R are in this condition. FIG. 49 is a fragmented exploded view of the lock assemblage 1 and an optional surface mounting bracket 11. Said surface mounting bracket 11 is fixed to a surface with surface mounting screws 11M. Said surface mounting screws 11M are installed through provided mounting holes 70 into a desired surface. The projected lower front and rear edges 71 of the front housing 1F, are complimentary to the beveled inner front and rear recesses 72 in the opening of the surface mounting bracket 11. The front and rear edges 71 are equivalent to each other. The complimentary bracket recessed openings 72 are equivalent to each other. The inside dimensions of the opening, of the bracket 11, are equivalent to the outside dimensions of the lock 1 not including the front and rear projections 71, that extends beyond the front or rear faces of the lock 1. This allows the lock 1 to be reversed in the direction it is placed into the bracket 11. FIG. 50 and FIG. 51 are fragmented sectional views of the lower portion of the lock assemblage 1 and the optional surface mounting bracket 11, on line 50—50 of FIG. 3. These views illustrate the installation of the housing halves 1F and 1R into the surface mounting bracket 11. The housing halves 1F and 1R must be in the unlocked and partly separated condition. Said lower rear projection 71 of the front housing 1F is inserted first into said complimentary rear recessed opening 72 of the surface mounting bracket 11. The front projection 71 of the front housing 1F follows into the front complimentary recessed opening 72 of the surface mounting bracket 11. FIG. 51 is a continuation of this event with the housing halves 1F and 1R, after fully contacting the bottom, moved forward in the opening, while the rear housing 1R is lowering into the closed condition, which will allow locking to be performed. Additionally, with the omission of the pin sets and complimentary apertures, the display only version would operate, in conjunction with the surface mounting bracket, the same as the locking type would. As was disclosed in the above description, there are various possibilities with regard to the disposition of the depicted components. Similarly there are various possibilities with regard to the materials used, and the techniques employed, to manufacture the push button firearm lock. The preferred material used to construct this device would be a structural grade of injection moldable plastic or resin. The components must be dyed, colored, or painted to prevent the interior workings of the lock from being seen. It is inconsequential what color, shade, or hue is utilized, with one provision. The components must be opaque. All of the components would be fashioned from this material except those on the following list; pin friction insert 2F, housing mounting screws 1M, adapter mounting screws 4M, wedge spring 6S, wedging screw 6W, latch spring 8S, latch mounting shoulder screws 8M, stop screw 9, surface mounting screws 11M, threaded attachment stud 42 for use with the complimentary locking or unlocking head 3L or 3U, latch pivot pins 61, and projection mounting screws 81. These items would be constructed with the standard materials employed today, such as; steel, iron, and or spring steel where applicable. The use of various grades of plastic on the listed parts, can be employed but would reduce long term durability. The use of injection moldable structural plastic, on the unlisted components, would greatly increase manufacturing volume capability and thereby decrease the final cost to the consumer. It is also possible to construct the unlisted components with a die cast metal, or machined from light weight metals such as aluminum, however the resulting production cost increase would be undesirable. The housing halves may also be constructed by layering sheets of the various types of materials, but this would also increase costs. The simplest preferred embodiment of the lock assemblage 1, would be fashioned entirely of structural grade injection moldable components, and contain no optional features. It would contain; a front housing 1F, a rear housing 1R, and a plurality of pin sets 2. The housing would be accommodating to only one type of firearm, and employ the simplest version of pin sets 2. This embodiment would obviate the need for component assembly, by the manufacturer, since consumers would desire the configuration of their own combination, thereby assembling this embodiment on their own. The pins would contain all of the features depicted in FIG. 12 including the friction projection 75. The use of the friction projection 75 would decrease the manufacturing cost of the pin sets 2, however the friction projection 75 would tend to wear down after a period of use, whereas the use of the alternative friction component 2F would increase production costs, but be more durable. This embodiment would therefor cost the least to manufacture and distribute. Additionally, with the omission of the pin sets and complimentary apertures, an inexpensive yet sturdy display is provided. With regard to the optional digit grip 86, the construction of these into the front and rear housings 1F and 1R could be included into the injection molding process or be fashioned into their respective surfaces later. The act of etching or engraving these digit grips 86 into the housing halves 1F and 1R after they have been constructed, would result in greater production costs. The optional firearm mounting adapter embodiment, of FIGS. 9 and 10, illustrates an alternative means given to the manufacturer, whereby one preferred simplified lock could be utilized with the capability of adapting to numerous styles, types, and brands of firearms, thereby decreasing the risk of overproducing a simplified lock capable of locking only one type of firearm. This adapter means would increase consumer cost initially, but also allow consumers the ability to purchase a lock assemblage with adapters fashioned for one firearm, and then only require the purchase of adapters to reapply the lock to other firearms. Additional modifications to the illustrated adapters and extensions can be employed to accommodate alternative types, styles, and brands. As an example, the shell casing ejection port 46, of FIG. 31 can be reshaped to extend into; the breech opening of a bolt action rifle, the breech opening of a pump action shot gun, or the shell casing ejection port of a semi-automatic rifle. Further, the slide blocking means 47, of FIG. 33 can be adjusted to conform to the structure of a breech loading shot gun. The hammer blocking means 48, shown in FIG. 34, can be adjusted to fit the top and hammer portions of a lever or pump action rifle. FIGS. 2, 5 through 8, and 12 through 17, illustrate the dimensional relationships of the various pin embodiments to each other, and to their accommodating apertures. The accompanying description provided above, if adhered to, will allow the manufacture the means of producing a multiplicity of locks which require a plurality of only one pin set. This means would also require the manufacture to fashion the housing with an, accompanying plurality of only one aperture. Not utilizing these dimensional relationships would require; the manufacturer to readjust tooling for every lock produced, produce a plethora of unlike pin sets for various combinations, and prevent the lock from being recodable. The illustrations of FIGS. 35 through 39 give the manufacturer an additional alternative multiple firearm mounting means, which would allow the manufacturer to produce a more universal lock, to accommodate numerous brands of firearms, without the need for adapters. The alternative multiple mounting means can offer the manufacturer one type of lock to produce, thereby lowering production costs, however may not apply to as broad a selection of firearm types, styles, and brands. Additionally, the alternative mounting means may also be employed in an adapter arrangement thereby allowing the manufacturer the ability to produce one lock with a multiple firearm mounting adapter. FIG. 21 through 25 provide the consumer with tamper resistant embodiment unlocking means, which can be desirable. In the event an individual forgets the combination, or inherits a firearm incased in the tamper resistant lock embodiment, the means to unlock the embodiment, would be convenient. This would also increase production cost, but also would increase consumer satisfaction. FIG. 40 through 48 provides the consumer with optional alternative latching and housing stop means which are desirable. In the event a large firearm is to be installed or removed from the lock assemblage 1, the lock can be more easily operated, when the latching and housing stop means are employed. This would increase production costs, but also provide greater consumer convenience. FIG. 49 through 51 provides the consumer with an additional alternative surface mounting means which is desirable. It is possible to utilize a number of surface mounting brackets 11, in conjunction with one lock assemblage 1, thereby providing the consumer, with the means to make stationary and then portable, the lock from one location to another, while still maintaining firearm security. This alternative mounting means would increase production cost, but also increase consumer convenience.

From the above description, a number of advantages of the push button firearm lock become evident:

a) The lock assemblage construction, utilizing injection moldable structural plastic, provide the manufacturer means of producing the lock in large volumes, without the need for manufacturer assembly, with a minimum of unlike components, and at an economical expense.

b) With the use of the adapter embodiment, this single lock embodiment may be produced with adapters to compliment scores of firearms.

c) With use of the alternative multiple firearm mounting means, this single lock embodiment may be produced without adapters, and still operate with a large variety of firearms.

d) With use of the alternative multiple firearm mounting means employed on adapters, a single lock may be produced with less adapters and still accommodate scores of firearms.

e) With use of the tamper resistance means, greater security is provided when the lock is left unattended.

f) With use of the optional tamper resistant unlocking means, the consumer is provided with a backup means of opening the lock without elaborate exercise or damage to the lock or firearm.

g) With use of the rounded outer simplified pin stem ends, or the haptic projection, means for in the dark operation are provided.

h) With use of the latching and stop means, the lock is made more convenient to operate.

i) With use of the surface mounting means, the lock is made portable or stationary, without tools require.

j) With use of the pin ramp, pin sets are repositioned automatically, upon closing of the lock.

k) With use of the digit grips, consumers are provided with an easier lock to open, at a slightly greater cost.

l) With the omission of the pin sets and complimentary apertures, a economical and sturdy display is provided.

Operation FIGS. 1 through 51

Note: The push button firearm lock was invented to provide consumers with a device capable of reducing the steps and time required to make their firearm operational, however, it is highly recommended to never leave a firearm, with a live cartridge in the firing chamber, unattended.

For the purpose of this operational description, the lock would be placed into the locked condition, by depressing all of the rear pins 2 of the rear housing 1R, forward in the lock 1. For use of this illustration, the same rule is used, when in consideration of the tamper resistant embodiment, employing the tamper resistant pin stem and button 3, in conjunction with the tamper resistant locking and unlocking heads 3L and 3U. All of the pin button and stems 3, like the simplified pins 2, are depressed into the rear housing side 1R, to place the lock into the locked condition. This action will cause the front housing pins 2, or the front housing tamper resistant stem and buttons 3, into a position whereby they are available to be depressed from the front side. To assemble the simplified or the tamper resistant embodiment, it is first necessary to decide on the unlocking combination. The unlocking combination is determined by choosing a pin depression pattern, as viewed from the front side of the lock 1, in which a pattern of pins shall be depressed, from the front, thereby placing the lock in the unlocked position. This pin pattern or combination can be a symbol, a letter of the users name, and so on. Once the combination has been determined, and the housing halves 1R and 1F are separated from one another, the locking pins 2L are inserted into the rear housing apertures, from the inside of the rear housing 1E, with the pin stem portion 78 inserted first. The locking pins 2L (long headed) are inserted into the rear housing apertures, that correspond to the unlocking pattern, as viewed from the outer facing side, of the front housing 1F, previously determined. The unlocking pins 2U (short headed) are then inserted into the remaining rear housing apertures, in the same manner as the locking pins 2L were inserted into the rear housing 1R. The front housing unlocking pins 2U, are then inserted into the front housing apertures, from the inside of the front housing 1F, with the pin stem portion 78 inserted first. The unlocking pins 2U are inserted into the front housing apertures, that also correspond to the unlocking pattern, previously determined. The front locking pins 2L follow, by insertion into the remaining front housing apertures. In these described embodiments, there will always be one locking pin 2L and one unlocking pin 2U, corresponding. The same rule consists with regard to, the tamper resistant pin stem 3 in conjunction with a tamper resistant locking head 3L, and a tamper resistant pin stem and button 3 in conjunction with a tamper resistant unlocking head 3U. Once the pins have been installed into their respective housing half, the housings 1F and 1R may be slid together on their mating housing tracks 26. This is accomplished by holding the rear housing 1R in the left hand, while inserting the front housing 1F upward into the rear housing 1R with the right hand. This act is assisted if the optional digit grips 86 have been incorporated into the lock housings. Once the housings are partially installed together a firearm, may be placed into the mating trigger guard mount 25. After the firearm has been installed, the housings may be closed fully to encase the firearm. The locking of the device will follow with the depression of all the rear pins 2. Thus, The lock will not open, unless the proper unlocking pattern in depressed on the front side of the lock. After the proper pin depression pattern has been performed, the housing may be slid open to expose the firearm for use. The act of opening the lock is further assisted if the digit grips 86 have been incorporated into the lock 1. The same assembly sequence is followed with regard to the tamper resistant embodiment, except there is an additional step. When the unlocking pattern has been determined, all of the pin stem and buttons 3 are installed into all of the recessed openings 31, from the outside of both housing halves. The tamper resistant locking heads 3L are then installed into the rear housing aperture, and threaded into the pin stem and button 3. This can be accomplished by using a typical flat head screw driver. The manner of assembling the remaining tamper resistant pin sets, would follow in the same fashion as was followed when the simplified pin sets 2 were earlier described. The manner of placement, of the locking and unlocking heads 3L and 3U, would follow in the same manner as was described for the simplified embodiment. Further, in the event the display only embodiment is employed the act of installing a firearm into the device would be the same, with the omission of the locking or unlocking steps.

Adapter installation is accomplished by separating the housing halves 1F and 1R. The adapters are installed by positioning them on there corresponding housing half 1F or 1R, then inserting the adapter mounting screws 4M through the adapter mounting holes 73, into the corresponding threaded mounting holes 74, of their respective housing halves. The screws are then tightened, thus converting them into an integral part of their respective housing. In the event a different adapter set is desired, it only requires the removal of the old adapters, and installation of the new.

The alternative multiple firearm mounting system is assembled by first separating the housing halves 1F and 1R. The trigger guard mounting means is configured to restrict the desired firearm from exit upward and backward, out of the lock. The mounting screws 7 are placed below and inside the trigger guard, into the corresponding threaded holes 57. A minimum of two of these mounting screws below the trigger guard, and one inside the trigger guard is required. This arrangement will prevent the firearm from movement up or down, or left to right, as shown in FIGS. 38 and 39. Three pins are required for a semi-automatic type firearm and would prevent trigger activation, by prohibiting left directional movement. An additional pin is required for use with a double or single action revolver. The fourth pin would be placed behind the trigger to prohibit hammer activation. Additional front to rear firearm movement can be removed by utilizing the wedging means, shown in FIGS. 35 through 37. The wedging block 6R is inserted into the rear housing 1R, on the meshing edge 55, into the receiving joint slot. Once these elements are installed, the wedge spring 6S is placed into the wedge spring hole 51. After the spring 6S has been placed the firearm to housing tension is adjusted with wedge screw 6W. The lock should be opened and closed over the desired firearm, while the tension is adjusted, to assure proper fit.

The optional; open latch 8L, closed latch 8U, and stop screw 9 are illustrated in FIGS. 40 through 48. To install the optional closed latch one begins with separating the housing halves 1F and 1R. The latch spring 8S is placed between the rear housing spring aperture 58 and the latch spring aperture 60. The latch 8L is then inserted into the latch mortise 63, with the latch pivots 61 correlating with the pivot pin mortises 66. The latch mounting screws 8M follow with installation into the threaded aperture 59. this act is accomplished by tightening the shoulder screws 8M with an appropriate screw driver or alike. The same procedure is followed, with regard to the installation of the open latch 8U. Once either or both of the latches 8U or 8L are install the front housing 1F, may be slid up the housing track 26. In the case of the open Latch 8U, it is necessary to depress the open latch 8U, to allow full travel upward of the front housing 1F, into the closed condition with the rear housing 1R. Once the housing halves 1F and 1R are closed, it will now require the depression of the closed latch 8L, to allow the lock 1 to be slid open. The open stop screw is installed, by first aligning he front housing stop screw access aperture 28 with the rear housing stop screw threaded aperture 69. this is accomplished by sliding the housing halves 1F and 1R until the apertures align. Once this has been achieved, the stop screw 9 is threaded into place, with a hex key or alike. After the stop screw 9 has been installed the front housing will only be allowed to travel a limited distance, thereby providing front and rear housing separation, but keeping them as one unit.

The optional pin unlocking means, of FIGS. 21 through 25, can be employed when the pin stems 2 or the pin stem and buttons 3, are fitted with the unlocking embrasure 76. It is only necessary to grasp the pin stems 2, or the pin stem and buttons 3, with the unlocking tool 13, in the unlocking embrasure 76 with the complimentary unlocking tool end 45. Once this has been achieved, the pins are to be pulled outward, away from the center of the lock, thereby unlocking it.

The operation of the optional surface mounting bracket 11 is shown in FIGS. 49 through 51. The surface mounting bracket 11 is mounted down to a surface, by installing the mounting screws 11M, through the mounting holes 70, into a desired surface, with an appropriate screw driver or alike. Once the bracket 11 has been mounted down, the lock 1 may be installed. With the housing halves slightly prolapsed, the rear portion of the lower front housing IF, utilizing its beveled edge projection 71, is first installed, with the lock held on a bias, into the complimentary rear opening 72, of the bracket 11. The lock 1 is forced backward into the opening, until it has engaged the rear of the opening 72 completely. The lock 1, still prolapsed, is lowered entirely into the bracket 11, and forced forward in the opening. The front housing lower beveled edge projection 71 is now hooked under the front portion of the bracket 11, in the accommodating edge 72. The rear housing 1R is now lowered into a closed condition with the front housing 1*f*. The lock 1 may now be placed into the locked condition, thereby securing it down to a fixed surface. To remove the lock 1, the user will find it only necessary to reverse the previous steps.

Summary, Ramifications, and Scope

Accordingly the reader will see that the push button firearm lock of this invention can be used to secure a firearm easily and conveniently, can be removed just as easily, with or without light present, can be constructed with a minimal of unlike components, and has many combinations of features. Furthermore, the firearm lock has additional advantages in that

* it permits the production of an economical, simplified, recodable lock that eliminates the need for manufacturer assembly;
* it permits the production of an adapter embodiment eliminating the need for the manufacture to produce an entire assembly for each type, style, or brand of firearm;
* it permits the lock to be made further tamper resistant thereby increasing the security of the lock;
* it permits the lock to be serviced more easily, in the event the lock combination is forgotten;
* it permits the manufacturer an alternative to adapters thereby providing the manufacturer with a multiple use firearm lock;
* it provides the manufacturer with an adapter means compatible with a multiple of firearms;
* it provides the consumer with optional features that allow easier handling, operation, and storage of the lock; and
* it provides the consumer with an economical yet sturdy display.

Although the description above contains many specifications, these should not be construed as limiting the scope of the invention but as merely providing examples of some of the presently preferred embodiments of this invention. For example, the lock housing itself can be altered in size as compared to the proportions illustrated or the housing halves may slide apart differently from the illustrations, in a radial or bias manner; the material used can be altered in the event a more economical, or easier to use material is found; the various shapes of the pins and corresponding apertures can be square, oval, triangular, trapezoidal, etc., a nylon material such as is used in the construction of nylon bolts and nuts may also be employed in the construction of the pins and housing; the tamper resistant pin stem, button, and heads may also separate differently, such as the buttons may be separable from the pin stems and the heads may be integral with the stems; the shape of the unlocking embrasure can be changed to a group of holes, or an unspecific such as a star, crescent, that would utilize a complimentary expandable pliers; the shape of the surface mount projection could also be altered from round to triangular, trapezoidal and so on; the alternative pin stem friction devices can also be relocated into the housing apertures or reshaped in conjunction with the pin stems, for example they can be circular and positioned around the pin stem, such as a rubber o-ring; the locking and unlocking pin heads may be of equal length, extending the length of the locking pin stems, and equipping the locking pins with a head spacer, would function the same as the preferred simplified lock including combination change by end over end rotation, but would add an additional unlike component, thereby increasing cost; the locking and unlocking pin heads may be flat on the interior end, convex or have a beveled edge; the housing tracks may take any shape as long as the housing halves are still interlocking and separation capable; and the sequence, described above, for assembling the lock may be altered depending on the users capabilities, in the event the user is left handed or prefers to separate the housing by grasping the rear portion with the right hand, etc.

Thus the scope of the invention should be determined also by the appended claims and their legal equivalents, rather than solely by the examples given.

I claim:

1. A device for securing firearms comprising:

A) a pin set of locking and unlocking pins comprising locking pin heads that are longer than unlocking pin heads each locking and unlocking pin head having a pin stem attached to one end of the locking and unlocking pin head, said locking and unlocking pin heads having substantially equal diameters and being greater in diameter than the diameter of the pin stems;

B) a front housing and a rear housing with outer faces, substantially flat inner faces, a plurality of stepped coaxial apertures to accommodate said locking and unlocking pins, each said stepped aperture comprising an outer pin stem aperture and an inner pin head aperture interconnecting the inner face and outer face of each housing respectively, wherein the outer aperture diameter is accommodating to the locking and unlocking pin stems and the inner aperture length is substantially the same as the locking pin heads and a diameter accommodating to the locking and unlocking pin heads;

C) a trigger guard mount mountable on the upper inside face of the rear housing;

D) front housing tracks located on the front housing; and

E) interlocking rear housing tracks located on the rear housing corresponding in opposition with the front housing tracks whereby the front housing and the rear housing are adapted to be slidably interengaged;

F) whereby said rear housing plurality of stepped apertures are coaxial with the front housing plurality of stepped apertures when the front and rear housings are slidably interengaged and the device is in a closed configuration.

2. The device of claim 1 wherein said locking and unlocking pin stems have a friction projection used to maintain the position of the locking and unlocking pins.

3. The device of claim 2 wherein said friction projection comprises of a substantially U-shaped wire with opposite ends of the wire attached to the locking and unlocking pin stems.

4. The device of claim 1 wherein said front housing further comprises a base portion projecting beneath said rear housing when the device is in the closed configuration.

5. The device of claim 4 wherein said base portion includes mounting apertures whereby said device is capable of being mounted to a surface.

6. The device of claim 4 including said base portion having front and rear projections; said device in combination with a surface mounting bracket with a top portion, a bottom portion and four side portions with mounting apertures for mounting said surface mounting bracket onto a surface;

an opening in the top portion permitting access to a front beveled recess and a rear beveled recess when the device is in an open configuration;

the base portion is adapted to be inserted into the opening with the front and rear projections of the base portion being received by the front and rear beveled recesses; when the rear housing is placed into the closed configuration the removal of the device from the surface mounting bracket is prevented.

7. The device of claim 1 wherein said front housing further comprises a stop screw slot and a stop screw aperture for inserting a stop screw into said rear housing, whereby the stop screw contacts the stop screw slot when the rear housing is raised, thus preventing complete disassembly of the device.

8. The device of claim 1 wherein a rear housing adapter is mounted to the rear housing with adapter mounting screws through rear housing adapter mounting holes into accommodating rear housing threaded mounting holes and a front housing adapter is mounted to the front housing with adapter mounting screws through front housing adapter mounting holes into accommodating front housing threaded mounting holes wherein said trigger guard mount is mountable on the rear housing adapter.

9. The device of claim 8 wherein said rear adapter further comprises a housing extension portion used to block access to an ammunition opening of an installed weapon, said housing extension portion having a mating cylinder concavity.

10. The device of claim 8 wherein said rear adapter further includes a casing ejection port projection thereby preventing a slide portion of a semi-automatic firearm from movement.

11. The device of claim 8 wherein said rear housing further comprises a magazine blocking projection thus preventing access to ammunition of an semi-automatic firearm.

12. The device of claim 11 wherein said magazine blocking projection is separable and is mounted to the rear housing with projection screws that am inserted through projection holes.

13. The device of claim 8 wherein said rear adapter further includes a slide projection enabling the device to block access to a slide of a semi-automatic firearm.

14. The device of claim 1 wherein the front and rear housing outer faces have a plurality of beveled openings, said locking and unlocking pin stems do not project beyond said beveled openings, said beveled openings being coaxial with each stepped aperture.

15. The device of claim 14 wherein said locking and unlocking pins further comprise an additional tamper resistant button of diameter greater than the pin stems and located at an end of the locking and unlocking pin stems opposite that of the locking and unlocking pin heads, furthermore, the stepped apertures include an additional aperture accommodating to the tamper resistant button and located between the front and rear housing outer faces and the outer pin stem apertures.

16. The device of claim 14 wherein each of said locking and unlocking pin heads further comprises a non-integral pin head with a threaded pin head mounting stud on one side and a head installation slot on an opposite side of the pin head, a threaded pin head mounting hole in an end of the pin stem, a haptic projection on the face of the button, whereby the head installation slot in the pin head is used to screw the pin head into the pin stem.

17. The device of claim 1 wherein said device further includes a pin repositioning ramp located on the upper inside face of the front housing and the lower inside face of the rear housing for the purpose of pushing the locking or unlocking pins back to coplanar alignment with the inside faces of the housings.

18. The device of claim 1 wherein said device further comprises it close latch, an open latch, a stop screw access aperture and digit grips on the front and rear housings, said digit grips located on upper left and right sides of the rear housing and lower left and right sides of the front housing.

19. The device of claim 1 wherein said trigger guard mount further comprises a plurality of trigger guard mount pin apertures located on the inner face of the rear housing and a plurality of trigger guard pins to be accommodated by said plurality of trigger guard mount apertures which enables the mounting of a variety of firearms.

20. The device of claim 1 further comprising at least one firearm wedging means, said wedging means comprising of a wedging block fitted with a meshing edge which is inserted into a complementary joint slot located in the mar housing and held outward with a tension spring, said spring being inserted into a complimentary spring aperture, whereby said wedging block is adjustable inward with a cone shaped wedging screw, said wedging screw being installed between the joint slot and a cone groove located on the wedging block.

21. The device of claim 1 further comprising a closed latch, said closed latch installed into a closed latch mortise and is movable on closed latch pivot pins which insert into closed latch pivot pin mortises, said closed latch is forced outward with a closed latch coil spring which installs between rear housing spring aperture and a closed latch spring aperture, said closed latch further having a closed catch ramp; an open latch, said open latch installed into an open latch mortise and is movable on open latch pivot pins which insert into open latch pivot pin mortises, said open latch is forced outward with an open latch coil spring which installs between rear housing spring aperture and an open latch spring aperture, said open latch and closed latch are restricted from exit by a latch mounting screw which is installed into a latch mounting screw threaded aperture located in the rear housing, furthermore an overlapping step is provided to retain the latch pivots while still allowing movement, said open latch further having a open catch ramp.

* * * * *